US009457576B2

(12) United States Patent
Ukeji et al.

(10) Patent No.: US 9,457,576 B2
(45) Date of Patent: Oct. 4, 2016

(54) INKJET PRINTING APPARATUS AND METHOD FOR CONTROLLING INKJET PRINTING APPARATUS

(71) Applicant: CANON KABUSHIKI KAISHA, Tokyo (JP)

(72) Inventors: Nobutaka Ukeji, Kawasaki (JP); Minoru Teshigawara, Saitama (JP); Yoshiaki Murayama, Tokyo (JP); Shinichi Yukiura, Kawasaki (JP); Takuya Hamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/698,173

(22) Filed: Apr. 28, 2015

(65) Prior Publication Data

US 2015/0314594 A1 Nov. 5, 2015

(30) Foreign Application Priority Data

Apr. 30, 2014 (JP) ..... 2014-093917

(51) Int. Cl.
*B41J 2/165* (2006.01)
*B41J 2/045* (2006.01)

(52) U.S. Cl.
CPC ..... *B41J 2/16517* (2013.01); *B41J 2/0458* (2013.01); *B41J 2/04501* (2013.01); *B41J 2/04528* (2013.01); *B41J 2/04545* (2013.01); *B41J 2/04596* (2013.01); *B41J 2/04598* (2013.01); *B41J 2/1652* (2013.01); *B41J 2/16585* (2013.01); *B41J 2002/16529* (2013.01); *B41J 2002/16573* (2013.01)

(58) Field of Classification Search
USPC ..... 347/34
See application file for complete search history.

(56) References Cited

U.S. PATENT DOCUMENTS 5,896,154 A * 4/1999 Mitani ..... B41J 2/1404 347/104
2004/0041873 A1 3/2004 Iwasaki et al.
2010/0079515 A1* 4/2010 Kuwahara ..... B41J 2/16585 347/14
2011/0234671 A1* 9/2011 Suzuki ..... B41J 2/16526 347/14
2015/0029248 A1* 1/2015 North ..... B41J 2/01 347/9

FOREIGN PATENT DOCUMENTS

JP 2013-107362 A 6/2013

* cited by examiner

*Primary Examiner* — Shelby Fidler
(74) *Attorney, Agent, or Firm* — Canon USA, Inc. IP Division

(57) ABSTRACT

An inkjet printing apparatus according to the present invention includes a first printing head that performs a first printing operation by discharging ink onto the printing medium, a second printing head positioned downstream from the first printing head in a transport direction and performing a second printing operation by discharging ink onto the printing medium, and a preliminary discharge controller that causes the second printing head to perform a preliminary discharging operation that does not contribute to the second printing operation, wherein the preliminary discharge controller causes an ink discharge amount of the preliminary discharging operation of the second printing head to be smaller when an ink discharge amount of the first printing operation is greater than or equal to a predetermined value than when the ink discharge amount of the first printing operation is less than the predetermined value.

16 Claims, 20 Drawing Sheets

FIG. 10

| APPLYING AMOUNT D | PRELIMINARY DISCHARGE AMOUNT Dyt | | |
|---|---|---|---|
| | TRANSPORT SPEED V OF PRINTING MEDIUM V [dot/sec] | | |
| | 2400 | 3600 | 4800 |
| LESS THAN 40 | (18) | (18) | (18) |
| 40 TO LESS THAN 60 | 16 | 14 | 12 |
| 60 TO LESS THAN 80 | 14 | 12 | 9 |
| 80 OR MORE | 12 | 9 | 6 |

(MAX)

FIG. 16

| PRINTING DATA SHIFTING AMOUNT | CORRECTION VALUE |
|---|---|
| 1920 | −2 |
| 3840 | −1 |
| 5760 | 0 |

FIG. 17

| | Dyt [dot] BEFORE CORRECTION | | |
|---|---|---|---|
| | K | C | M |
| Dyt1 | 12 | 16 | 6 |
| Dyt2 | 9 | 12 | 12 |
| Dyt3 | 6 | 14 | 12 |
| Dyt4 | 6 | 14 | 6 |
| Dyt5 | 6 | 16 | 6 |
| Dyt6 | 14 | 12 | 9 |
| Dyt7 | (18) | 16 | 6 |
| Dyt8 | 16 | 9 | 16 |
| Dyt9 | 9 | 12 | 16 |
| Dyt10 | 6 | 12 | (18) |
| Dyt11 | 14 | 14 | 16 |
| Dyt12 | 12 | 14 | 9 |
| Dyt13 | (18) | 6 | 14 |
| Dyt14 | 14 | 12 | 9 |
| Dyt15 | 6 | 9 | 16 |
| Dyt16 | 16 | 9 | 6 |
| Dyt17 | 9 | (18) | 9 |
| Dyt18 | 12 | 9 | 14 |
| Dyt19 | 16 | 16 | 9 |
| Dyt20 | (18) | (18) | 16 |
| Dyt21 | 14 | 9 | (18) |
| | | | (MAX) |

CORRECTION

| | Dyt [dot] AFTER CORRECTION | | |
|---|---|---|---|
| | K | C | M |
| Dyt1 | 12 | 15 | 4 |
| Dyt2 | 9 | 11 | 10 |
| Dyt3 | 6 | 13 | 10 |
| Dyt4 | 6 | 13 | 4 |
| Dyt5 | 6 | 15 | 4 |
| Dyt6 | 14 | 11 | 7 |
| Dyt7 | (18) | 15 | 4 |
| Dyt8 | 16 | 8 | 14 |
| Dyt9 | 9 | 11 | 14 |
| Dyt10 | 6 | 11 | (18) |
| Dyt11 | 14 | 13 | 14 |
| Dyt12 | 12 | 13 | 7 |
| Dyt13 | (18) | 5 | 12 |
| Dyt14 | 14 | 11 | 7 |
| Dyt15 | 6 | 8 | 14 |
| Dyt16 | 16 | 8 | 4 |
| Dyt17 | 9 | (18) | 7 |
| Dyt18 | 12 | 8 | 12 |
| Dyt19 | 16 | 15 | 7 |
| Dyt20 | (18) | (18) | 14 |
| Dyt21 | 14 | 8 | (18) |
| | | | (MAX) |

EXCLUDE MAXIMUM PRELIMINARY DISCHARGE COEFFICIENTS (18) AND CALCULATE AVERAGE VALUE

Ave

AVERAGE VALUE OF Dyt = 10.32

Dy = 11

FIG. 18

| NUMBER OF BLOCKS | CORRECTION VALUE |
|---|---|
| 1 TO M | 1 |
| M+1 TO 2M | 0.8 |
| 2M+1 TO 3M | 0.6 |

| | Dyt [dot] AFTER CORRECTION | | |
|---|---|---|---|
| | K | C | M |
| Dyt1 | 12 | 15 | 4 |
| Dyt2 | 9 | 11 | 10 |
| Dyt3 | 6 | 13 | 10 |
| Dyt4 | 6 | 13 | 4 |
| Dyt5 | 6 | 15 | 4 |
| Dyt6 | 14 | 11 | 7 |
| Dyt7 | (18) | 15 | 4 |
| Dyt8 | 16 | 8 | 14 |
| Dyt9 | 9 | 11 | 14 |
| Dyt10 | 6 | 11 | (18) |
| Dyt11 | 14 | 13 | 14 |
| Dyt12 | 12 | 13 | 7 |
| Dyt13 | (18) | 5 | 12 |
| Dyt14 | 14 | 11 | 7 |
| Dyt15 | 6 | 8 | 14 |
| Dyt16 | 16 | 8 | 4 |
| Dyt17 | 9 | (18) | 7 |
| Dyt18 | 12 | 8 | 12 |
| Dyt19 | 16 | 15 | 7 |
| Dyt20 | (18) | (18) | 14 |
| Dyt21 | 14 | 8 | (18) |

(MAX)

INKJET PRINTING APPARATUS AND METHOD FOR CONTROLLING INKJET PRINTING APPARATUS

BACKGROUND

1. Field of the Invention

The present disclosure relates to an inkjet printing apparatus and a method for controlling an inkjet printing apparatus.

2. Description of the Related Art

Inkjet printing apparatuses are widely used in the field of printing images, such as monochrome and full-color images. In a printing head of an inkjet printing apparatus, when a nozzle that discharges ink from the printing head is exposed to the atmosphere for a long time, a discharging failure caused by, for example, the adhesion of dust or the drying of ink near the discharge nozzle tends to occur. In order to prevent such a discharging failure, a preliminary discharging operation method (hereunder may simply be referred to as "preliminary discharge") for preliminarily discharging ink that does not directly contribute to a printing operation is proposed. In other words, in order to guarantee a time in which normal discharge from the printing head is expected (hereunder referred to as "printable time"), a preliminary discharging operation is performed by discharging a predetermined amount of ink to a discharge port surface of the printing head at a predetermined time interval.

For example, US 2004-0041873 (Patent Literature 1 (PTL 1)) proposes a method for performing a preliminary discharging operation with respect to a discharge nozzle in accordance with the number of discharges of ink that is discharged from the nozzle (that is, the discharge amount of ink from the nozzle). More specifically, the preliminary discharge is performed when the number of discharges of ink from the discharge nozzle is less than a predetermined number of discharges of ink from the discharge nozzle within a predetermined time, whereas preliminary discharge is not performed when this value is greater than or equal to the predetermined number of discharges of ink from the discharge nozzle within the predetermined time.

In PTL 1, although preliminary discharge control is performed in accordance with the number of discharges of ink discharged for a printing operation, it cannot be said that the reduction of consumption of ink that is used in the preliminary discharge has been sufficiently considered. Therefore, there is room to further reduce the consumption of ink that is used in the preliminary discharge.

For example, in forming an image on a printing medium using ink that is discharged from a plurality of nozzles, a surrounding ambient humidity may increase as a result of evaporation of moisture in the ink from an area where an image is formed. However, in the state of the art including the invention of PTL 1, consideration has not been made while focusing on the application of a humidification effect resulting from the evaporation of the moisture in the ink that is included in the image in this area when a front surface of the nozzle (discharge port surface) passes above the area where the image is formed.

SUMMARY

Disclosed herein is an inkjet printing apparatus that is capable of further reducing the consumption of ink that is used in preliminary discharge by effectively utilizing a humidification effect resulting from the evaporation of moisture in ink that has been discharged earlier to a printing medium.

According to the present disclosure, there is provided a an inkjet printing apparatus including a transporting unit that transports a printing medium in a transport direction, a first printing head that performs a first printing operation by discharging ink onto the printing medium, a second printing head positioned downstream from the first printing head in the transport direction and performing a second printing operation by discharging ink onto the printing medium, and a preliminary discharge controller that causes the second printing head to perform a preliminary discharging operation that does not contribute to the second printing operation. The preliminary discharge controller causes an ink discharge amount of the preliminary discharging operation to be smaller when an ink discharge amount of the first printing operation is greater than or equal to a predetermined value than when the ink discharge amount of the first printing operation is less than the predetermined value.

Further features of the present invention will become apparent from the following description of exemplary embodiments with reference to the attached drawings.

BRIEF DESCRIPTION OF THE DRAWINGS

FIG. 10 is a preliminary discharge coefficient table of the inkjet printing apparatus according to the first exemplary embodiment.

FIG. 16 is a table of correction values that are added to the preliminary discharge coefficients of the inkjet printing apparatus according to the first exemplary embodiment.

FIG. 17 shows an example of correcting the preliminary discharge coefficients using the correction-value table shown in FIG. 16.

FIG. 18 is a table of correction values corresponding to the effective number of dot counting blocks of an inkjet printing apparatus according to a second exemplary embodiment.

DESCRIPTION OF THE EMBODIMENTS

An inkjet printing apparatus and a method for controlling an inkjet printing apparatus according to the present invention are hereunder described in detail with reference to exemplary embodiments.

First Exemplary Embodiment

A first exemplary embodiment according to the present invention is described using a full-line inkjet printing apparatus 1 (hereunder simply referred to as "inkjet printing apparatus").

1. Main Structure of Inkjet Printing Apparatus

Figure 1:
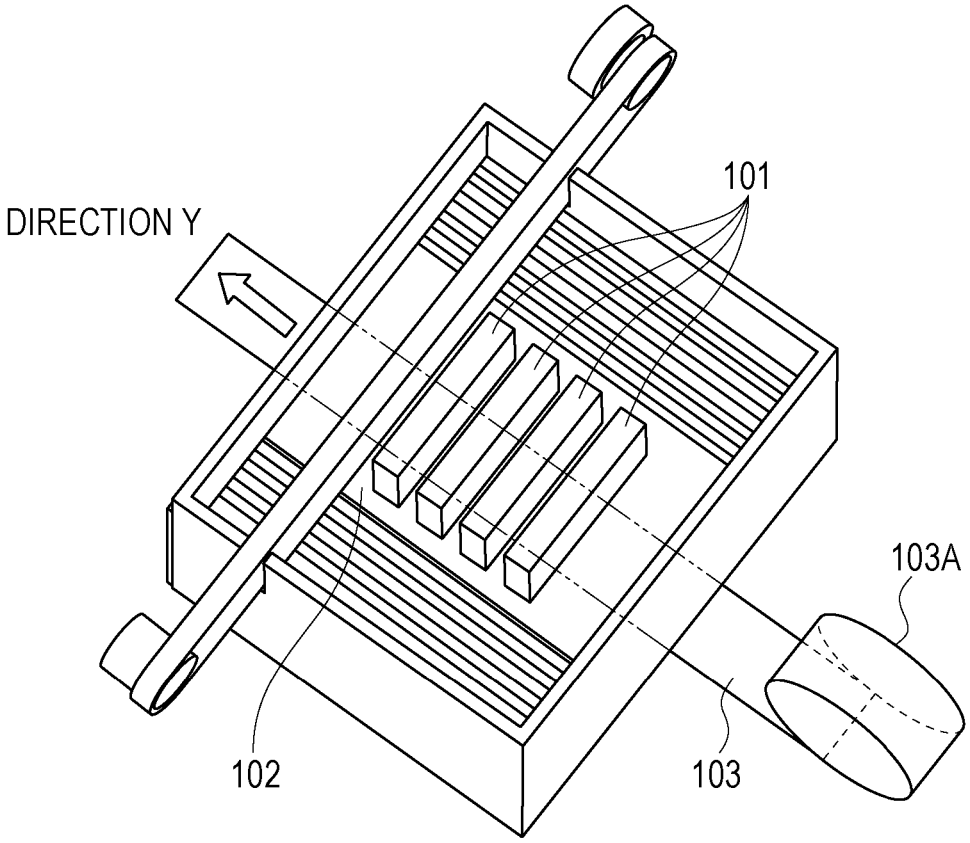
FIG. 1 is a schematic perspective view of a main structural portion of an inkjet printing apparatus according to a first exemplary embodiment.

FIG. 1 is a schematic perspective view of a main structural portion of an inkjet printing apparatus 1 according to the first exemplary embodiment of the present invention.

The inkjet printing apparatus 1 according to the first exemplary embodiment includes a printing head 101 and a holder 102. The printing head 101 performs a printing operation. The holder 102 holds heads of the printing head 101 together. The inkjet printing apparatus 1 includes a sheet feeding unit 103A that is disposed at an uppermost stream side in a printing-medium transport direction Y for setting a roll of printing medium 103 (roll paper). The inkjet printing apparatus 1 includes a sheet feeding/supplying mechanism (not shown) that transports the printing medium 103 at a predetermined speed during a printing operation by transporting the printing medium 103 up to a location opposing the printing head 101 along the transport direction Y.

As shown in FIG. 1, the inkjet printing apparatus 1 prints images on the printing medium 103 by causing ink to be discharged onto the printing medium 103 from the printing head 101. The term "images" here is a conceptually wide term including, for example, "characters", "diagrams", "designs", and "patterns" that are capable of being formed on a printing medium.

After the printing operation of the printing head 101 ends, the printing medium 103 on which the images have been printed is transported to a cutting unit (now shown) and is cut to a predetermined length. The cut printing medium 103 is further transported to a drying unit (not shown) and the ink on the printing medium 103 is dried. The dried printing medium 103 is then discharged from the drying unit and is placed upon a sheet discharging unit (not shown).

In the first exemplary embodiment, the holder 102 includes a moving mechanism (not shown) that is capable of moving the printing head 101 in a direction of discharge of ink (up-down direction). This allows the distance between a discharge port surface of the printing head 101 and a surface of the printing medium 103 to be changed. Since the printing head 101 is capable of moving in a direction orthogonal to a printing surface of the printing medium 103, the printing head 101 is capable of moving to positions other than where a printing operation is carried out. For example, such positions include a position where preliminary discharge is performed away from the printing medium 103, a position where a nozzle surface (the discharge port surface of the printing head 101) is wiped, and a capping position where drying of the nozzle surface is suppressed by capping the nozzle surface when a printing operation is not performed.

The inkjet printing apparatus 1 according to the first exemplary embodiment further includes a control unit (not shown) that is described later. The control unit controls the printing head 101, the sheet feeding/supplying mechanism, a sheet discharging mechanism, and other mechanisms. The inkjet printing apparatus 1 still further includes a power supply unit (not shown). The power supply unit supplies electric energy to mechanisms, such as a driving unit (not shown), the printing head 101, and a heater board (not shown).

1-1. Structure of Printing Head

Figure 2A:
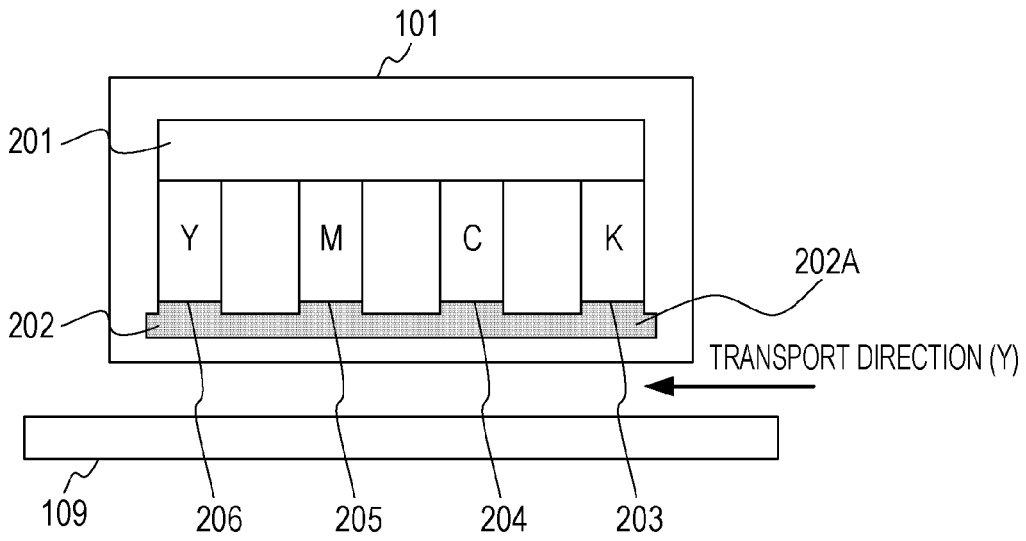
FIG. 2A is a schematic view of a structure of a printing head of the inkjet printing apparatus according to the first exemplary embodiment.
Figure 2B:
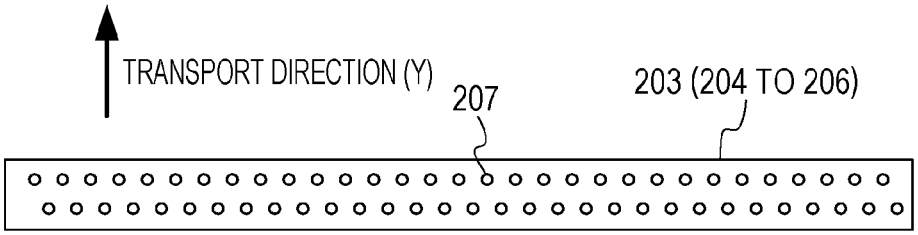
FIG. 2B is a schematic view of an arrangement of nozzles at an ink discharge port surface of the printing head.

Using FIGS. 2A and 2B, a structure of the printing head 101 of the inkjet printing apparatus according to the first exemplary embodiment is hereunder described in detail. FIG. 2A is a schematic view of the structure of the printing head. FIG. 2B is a schematic view of an arrangement of nozzles (ink discharge ports) at the ink discharge port surface of the printing head.

The printing head 101 according to the first exemplary embodiment is a full-line printing head having a length that is greater than or equal to the width of a sheet on which printing is performed. The printing head 101 is set at the inkjet printing apparatus 1 so as to be orthogonal to or at a constant angle from the printing-medium transport direction Y.

The printing head 101 includes line heads 203 to 206 having a printing width that is equivalent to the length of a printing area in a width direction. The line heads 203 to 206 are held by the holder 102 in the order of the black (K) line head, the cyan (C) line head, the magenta (M) line head, and the yellow (Y) line head. Inks of the respective colors are supplied from ink tanks (not shown) via respective ink tubes (not shown) to the printing head 101 (the respective line heads 203 to 206). Since the line heads 203 to 206 are independently provided, they are individually removable from the holder 102.

In the first exemplary embodiment, the K line head 203, the C line head 204, and the M line head 205 are "first printing heads" according to the present invention, and the Y line head 206 is a "second printing head" according to the present invention. The line heads 203 to 205 form "unit printing heads" according to the present invention.

As shown in FIG. 2A, the inkjet printing apparatus 1 includes a recovering unit 202 that causes a discharge function of the printing head 101 to be recovered. More specifically, the recovering unit 202 includes a cap 202A that covers the discharge port surface of the printing head 101. The recovering unit 202 includes a suction unit (not shown) that communicates with the inside of the cap 202A and that can forcefully suck ink from the discharge port surface of the printing head 101 to discharge the ink.

In a stand-by state in which a printing operation is not performed or during a recovery operation in which the function of the printing head is being recovered, the recovering unit 202 (the cap 202A) is in close contact with and caps the discharge port surface (each of the line heads 203 to 206) of the printing head 101.

In contrast, when a printing operation is performed, first, a moving unit (not shown) causes the recovering unit 202 (the cap 202A) to withdraw from a capping position along the printing-medium transport direction Y. Then, the moving mechanism moves the printing head 101 to a position where the printing operation (ink discharge) can be performed on the printing medium 103, to start the discharge of ink (the printing operation).

When the printing operation ends, the moving mechanism causes the printing head 101 to move in the reverse order, and to return to the state shown in FIG. 2A. Therefore, the printing head 101 is set in close contact with and caps the recovering unit 202 (the cap 202A) again, and is in a stored state or a state in which its function can be recovered.

As shown in FIG. 2B, two rows of nozzle arrays 207 providing a resolution of 600 dpi are disposed in a staggered pattern so that a resolution of 1200 dpi is provided in a direction X that is orthogonal to (that intersects) the transport direction Y. Therefore, it is possible to form dots with a resolution of 1200 dpi in the direction X on a printing medium. Although, in the first exemplary embodiment, two rows of nozzle arrays are described, other number of rows of nozzle arrays may be disposed.

Although the printing head 101 according to the first exemplary embodiment is one using a system which includes heat generation elements and which discharges ink by causing the state of the ink to change by heat energy, the system is not limited to one that uses heat energy. The printing head 101 may use a system which discharges ink by vibration energy. In the first exemplary embodiment, ink is discharged at approximately 5 pl/one time from each nozzle 207.

In order to recover (maintain) a proper discharge performance of the printing head 101, a recovering mechanism is provided in addition to the above-described recovering unit 202. The recovering mechanism functions to perform a pressurization circulation recovery operation and a cleaning operation. In the pressurization circulation recovery operation, under a predetermined condition, ink in the head is pressurized, circulated, and recovered. In the cleaning operation, the nozzle surface is wiped by a wiper blade (not shown).

1-2. Printing Head Controller

The inkjet printing apparatus according to the first exemplary embodiment includes the control unit (not shown). The control unit controls, for example, the printing head 101, the sheet feeding/supplying mechanism (not shown), the sheet discharging mechanism, and other mechanisms (not shown). Of the control unit, a printing head controller (hereunder referred to as (controller) which is a characteristic feature of the present invention and which controls the printing head 101 is described in detail below. The controller forms a "preliminary discharge controller" according to the present invention.

Figure 3:
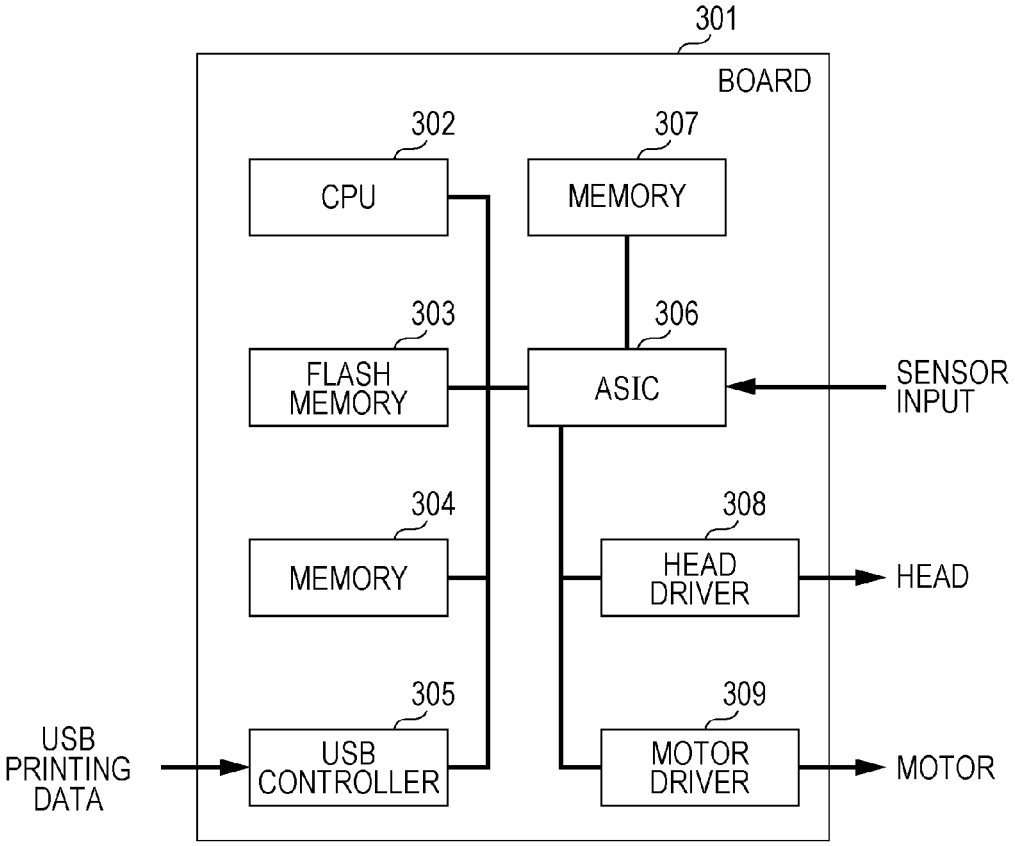
FIG. 3 shows a structure of a controller that controls the printing head of the inkjet printing apparatus according to the first exemplary embodiment.

FIG. 3 shows a structure of a board 301 (the controller) that controls the printing head 101 according to the first exemplary embodiment. As shown in FIG. 3, the board 301 is primarily provided with structural portions, such as a CPU 302, a flash memory 303, memories 304 and 307, a USB controller 305, an ASIC 306, a head driver 308, and a motor driver 309. The functions of the respective structural portions at the board 301 are described in detail below.

In the first exemplary embodiment, first, image data to be printed is generated by software in a personal computer (PC). This image data in a compressed state is transmitted to the inkjet printing apparatus via a communication interface, such as a USB interface.

The CPU 302 operates on the basis of a program stored in the flash memory 303, temporarily rasterizes the compressed image data, received from the PC via the USB controller 305, at the memory 304, and transfers the data to the ASIC 306. Using the printing data storage memory 307 (VRAM) to which the ASIC 306 is connected, the compressed image data is stored while decompressing the compressed image data, and transmits printing data to the head driver 308 to print the printing data.

In printing the printing data, the ASIC 306 controls the motor driver 309 while confirming the state of, for example, a motor (not shown), an encoder of a transporting system (not shown), or a sheet detection sensor (not shown) as a result of a sensor input. That is, the printing of the printing data is performed while the control unit performs overall control on, for example, the printing head 101 and the recovering unit 202.

The board 301 (controller) controls both an operation for discharging ink for forming an image on a printing medium using the printing head 101 (that is, a printing operation) and an operation for discharging ink for recovering the discharge function of the printing head 101 (that is, a preliminary discharging operation that does not contribute to the printing operation). More specifically, the board 301 controls, for example, an ink discharge amount and a discharge timing. In addition, the board 301 controls a transport speed of a transporting unit (not shown) via the motor driver 309.

Although, in the first exemplary embodiment, the case in which the inkjet printing apparatus 1 performs a printing operation by receiving compressed image data from the PC via the USB controller 305 is described, the inkjet printing apparatus 1 may perform a printing operation (may print an image) on the basis of data obtained from something other than the PC. For example, if the inkjet printing apparatus is one on which a scanner unit is mounted, the printing operation may be performed by storing image data that has been scanned and obtained in, for example, the memory 304.

2. Preliminary Discharge Control of Printing Head

Preliminary discharge control of the printing head according to the first exemplary embodiment is hereunder described.

In general, a form of the preliminary discharging operation for recovering the discharge function of the printing head 101 includes "capping preliminary discharge" that is performed in the capped state shown in FIG. 2. Other forms include "preliminary discharge between images" that is performed on a non-printing area between printing pages and "sheet preliminary discharge" that is performed such that a print does not stand out in a printing area independently of data to be printed during a printing operation. In the first exemplary embodiment, control of "preliminary discharge between images" is described. Unless specially mentioned, "preliminary discharge" below refers to "preliminary discharge between images".

When the inkjet printing apparatus performs a printing operation on a printing medium, images that have been printed by discharging ink by the line heads 203 to 205 (that is, predetermined printing areas), which are positioned at an upstream side in the transport direction Y, are transported to a portion opposing the line head 206 that is positioned at a downstream side by the transporting unit. By evaporation of the discharged inks of the images from the line heads 203 to 205, a humidification effect occurs with respect to the line head 206. In the first exemplary embodiment, such a humidification effect is utilized, and on the basis of an ink discharge amount of a printing operation (first printing operation) of each of the upstream line heads 203 to 205, an ink discharge amount (a preliminary discharge amount) of the preliminary discharging operation of the downstream line head 206 is calculated and determined. Similarly to the upstream line heads, the downstream line head 206 also performs a printing operation (a second printing operation) by discharging ink on the printing medium.

In the first exemplary embodiment, the preliminary discharge amounts of the line heads 203 to 206 are calculated and determined when compressed image data is being decompressed. That is, the preliminary discharge amounts are determined before printing (recording) of the image data that is used to calculate the preliminary discharge amounts.

Figure 4:
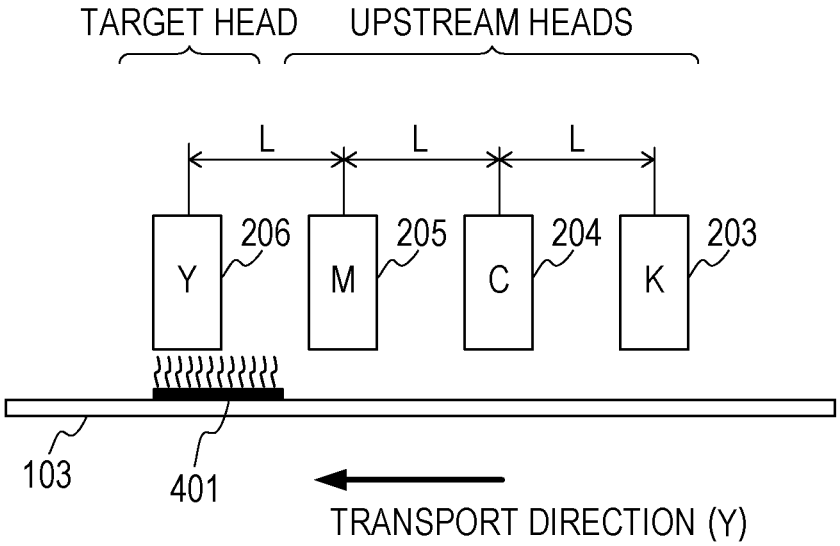
FIG. 4 is a conceptual view illustrating a humidification effect resulting from the evaporation of ink with respect to the printing head of the inkjet printing apparatus according to the first exemplary embodiment.

FIG. 4 is a conceptual view illustrating a humidification effect resulting from the evaporation of ink with respect to the printing head 101. As shown in FIG. 4, in the first exemplary embodiment, of the four line heads, the line head 206 (the second printing head) is a target head whose preliminary discharge amounts are to be controlled, and the line heads 203 to 205 that are positioned upstream from the line head 206 in the transport direction Y are upstream heads (the first printing heads). On the basis of applying amounts (ink discharge amounts) of the upstream heads 203 to 205, the preliminary discharge amounts of the line head 206, which is a target head, is controlled. In the first exemplary embodiment, the preliminary discharge amounts of the upstream line heads 203 to 205 are performed on the basis of preset preliminary discharge amounts in accordance with the above-described "printable time".

After printing (recording) print images 401 on the printing medium 103 by the upstream heads (the line heads 203 to 205) that are positioned at the upstream side, moisture included in the ink applied (discharged) to the area of the print images 401 (a predetermined printing area) evaporates. Therefore, the ambient humidity above the area of the print images 401 also increases. As a result, by successively moving the printing medium 103 in the transport direction Y, when the target head (the line head 206) that is positioned at the downstream side is positioned so as to oppose the area of the print images 401, the target head is humidified by the evaporation of the moisture of the ink in the area of the print images 401. Therefore, the preliminary discharge amounts can be set to a small amount in correspondence with a reduction in drying of the discharge port surface of the target head (the line head 206).

Figure 5:
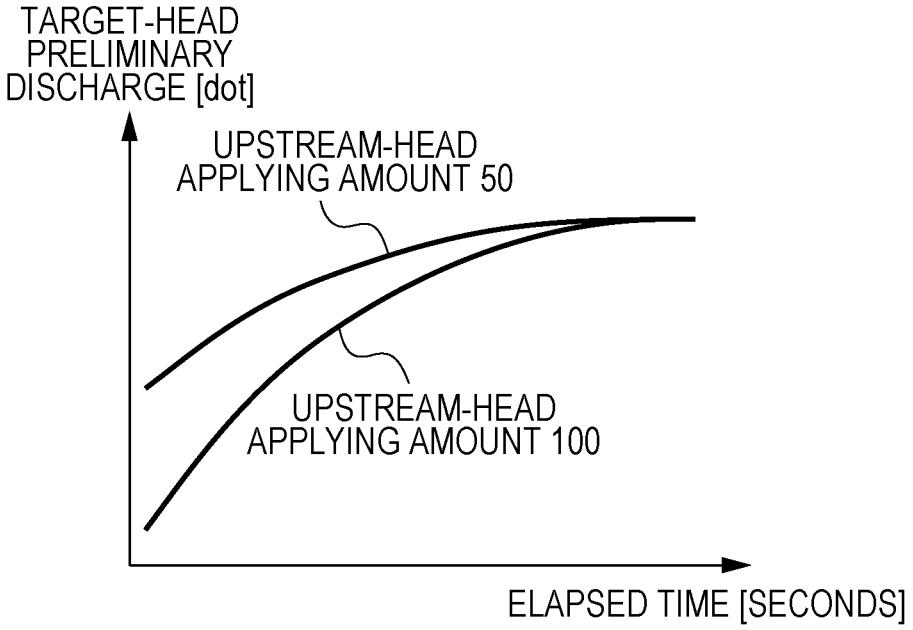
FIG. 5 is a graph showing correlation between an applying amount by each upstream head of the inkjet printing apparatus according to the first exemplary embodiment of the present invention, an elapsed time after the application, and a preliminary discharge amount that a target head requires.

FIG. 5 is a graph showing relationship between the applying amount to the print image 401 by each upstream head, the elapsed time up to when the area of the print images 401 reaches a portion opposing the target head after the printing of the print image 401 by each upstream head, and the preliminary discharge amounts that the target head requires.

FIG. 5 shows that, since the moisture evaporation action (the diffusability of water molecules in the air) is increased as the discharge amounts (the applying amounts) of the upstream heads are increased and as the elapsed time that has elapsed after the discharge is reduced, it is possible to prevent the drying of the nozzles of the target head even if the preliminary discharge amounts are relatively small. In contrast, as the discharge amounts (the applying amounts) of the upstream heads are reduced and as the elapsed time that has elapsed after the discharge is increased, the moisture evaporation action is reduced. As a result, in order to effectively prevent the drying of the nozzles of the target head, relatively large preliminary discharge amounts is required.

In the first exemplary embodiment, since the applying amounts (the discharge amounts) are provided using a relative value when a maximum applying amount (a maximum discharge amount) with respect to the predetermined printing area is 100, the applying amounts may be represented by any units. Although, in the first exemplary embodiment, adjacent line heads are disposed apart from each other by an equal interval (a distance L), the present invention is not limited thereto. The line heads need not be disposed at an equal interval.

Although, in the first exemplary embodiment, referring to FIG. 2B, the nozzles provided in the discharge port surface of each line head are disposed in a plurality of rows, the interval between two adjacent nozzle rows can be ignored because this interval is sufficiently smaller than the interval between two adjacent line heads. Therefore, in calculating the applying amounts and the preliminary discharge amounts, they may be calculated for each line head. When the interval between adjacent nozzle rows in each line head is so large that the interval cannot be ignored, the preliminary discharge amount of a downstream nozzle row may be individually controlled while considering the humidification effect that the print image printed by the upstream nozzle row has on the downstream nozzle row.

2-1. Method for Calculating Ink Discharge Amounts (Applying Amounts) of Upstream Heads In order to determine the preliminary discharge amounts of the target head (the downstream head), the ink discharge amounts of the upstream heads are previously acquired.

The method for calculating the ink discharge amounts (the applying amounts) for printing operations by the upstream heads is hereunder described.

In the first exemplary embodiment, the ink discharge amounts (the applying amounts) are calculated by a count unit that obtains (counts) the number of discharges of ink from the printing head 101 (that is, counts the number of dots). The count unit can be formed from, for example, the CPU 302.

In the first exemplary embodiment, the counting of dots (the calculation of the applying amount) by the count unit is performed by dividing printing data to be printed on a predetermined printing area into a plurality of dot count blocks (basic unit blocks). The dot count blocks are described with reference to FIGS. 6 and 7. The dot resolution that is used in describing the first exemplary embodiment is expressed in 1200 dpi in all cases.

Figure 6:
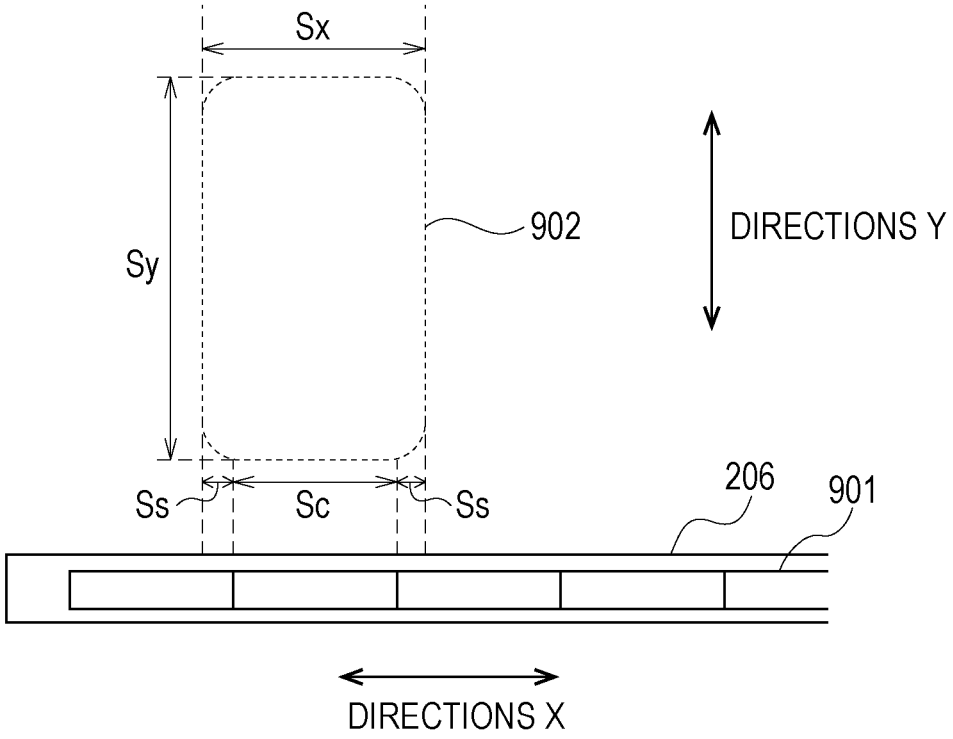
FIG. 6 is a conceptual diagram for defining a dot counting block of the inkjet printing apparatus according to the first exemplary embodiment.

As shown in FIG. 6, in the first exemplary embodiment, the size of one dot count block may be Sx×Sy [dot]. Sx represents a unit size (predetermined length) in a horizontal direction (a nozzle-row direction X), and Sy represents a unit size in a vertical direction (the printing-medium transport direction Y). Therefore, the size of one dot count block for determining the applying amount is a unit area Sx×Sy (range) prescribed by the unit size Sx in the horizontal direction and the unit size Sy in the vertical direction.

The evaporation of the moisture included in the print images 401 not only provides a humidification effect at a location that is directly above the print images 401, but also provides a humidification effect by diffusion of the moisture to surrounding areas. Therefore, it is desirable that the size of one dot count block for determining the applying amount be larger than the size of a processing unit block in the nozzle row direction (the direction of arrangement of the ink discharge ports) of the line head 206 (the second printing head) whose preliminary discharge amounts is to be determined.

For example, as shown in FIG. 6, in the first exemplary embodiment, in order to determine the preliminary discharge amounts of the target head 206 in the nozzle-row direction X, processing unit blocks 901 are set. The size of each processing unit block 901 in the direction X is Sc [dot].

On the basis of the size Sc of one of the processing unit blocks 901 (such as the processing unit block 901 in a second column from the left), the size Sx in the horizontal direction X of a dot count block 902 corresponding to the processing unit block 901 is determined. The size Sx of the dot count block 902 in the horizontal direction X is equal to the sum of the size Sc [dot] of the processing unit block 901 in the horizontal direction and sizes Ss [dot] at respective ends of the dot count block 902. That is, Sx=Sc+2Ss [dot]. The sizes Ss are added because it is assumed that the evaporation of the ink is diffused in surrounding areas in the horizontal direction, so that a humidification effect is provided.

In the first exemplary embodiment, the size of one dot count block in the horizontal direction X is Sx=64 [dot], and the doubled sizes in the horizontal direction X is 2Ss=32 [dot]. That is, Sc=32 [dot] and Ss=16 [dot]. The size of one dot count block in the vertical direction Y is Sy=640 [dot].

Considering the time during which a humidification effect can be provided from the dot count block, the size of one dot count block in the vertical direction Y may be set as appropriate in accordance with the transport speed. That is, a required passage time T when the dot count block passes the discharge ports (a nozzle area) changes due to the transport speed of a printing medium.

More specifically, when the transport speed is high, the required passage time T is short, whereas, when the transport speed is low, the required passage time T is long. Therefore, for dot count blocks having the same size, if the transport speeds differ from each other, the times allowing them to oppose the discharge ports of the target head (their required passage times) differ from each other. As a result, the times during which the discharge ports can be subjected to a humidification effect differ from each other.

In order to remove such an effect arising from the differences between the transport speeds, if the size Sy of the dot count block in the direction Y (the transport direction Y) is previously adjusted in accordance with the transport speed V, the effect of the transport speed V is removed when determining a preliminary discharge coefficient Dyt. Therefore, even if the transport speeds differ from each other, it is possible to precisely determine the preliminary discharge coefficient Dyt so as to obtain a more stabilized humidification effect regardless of the transport speed V.

Figure 7:
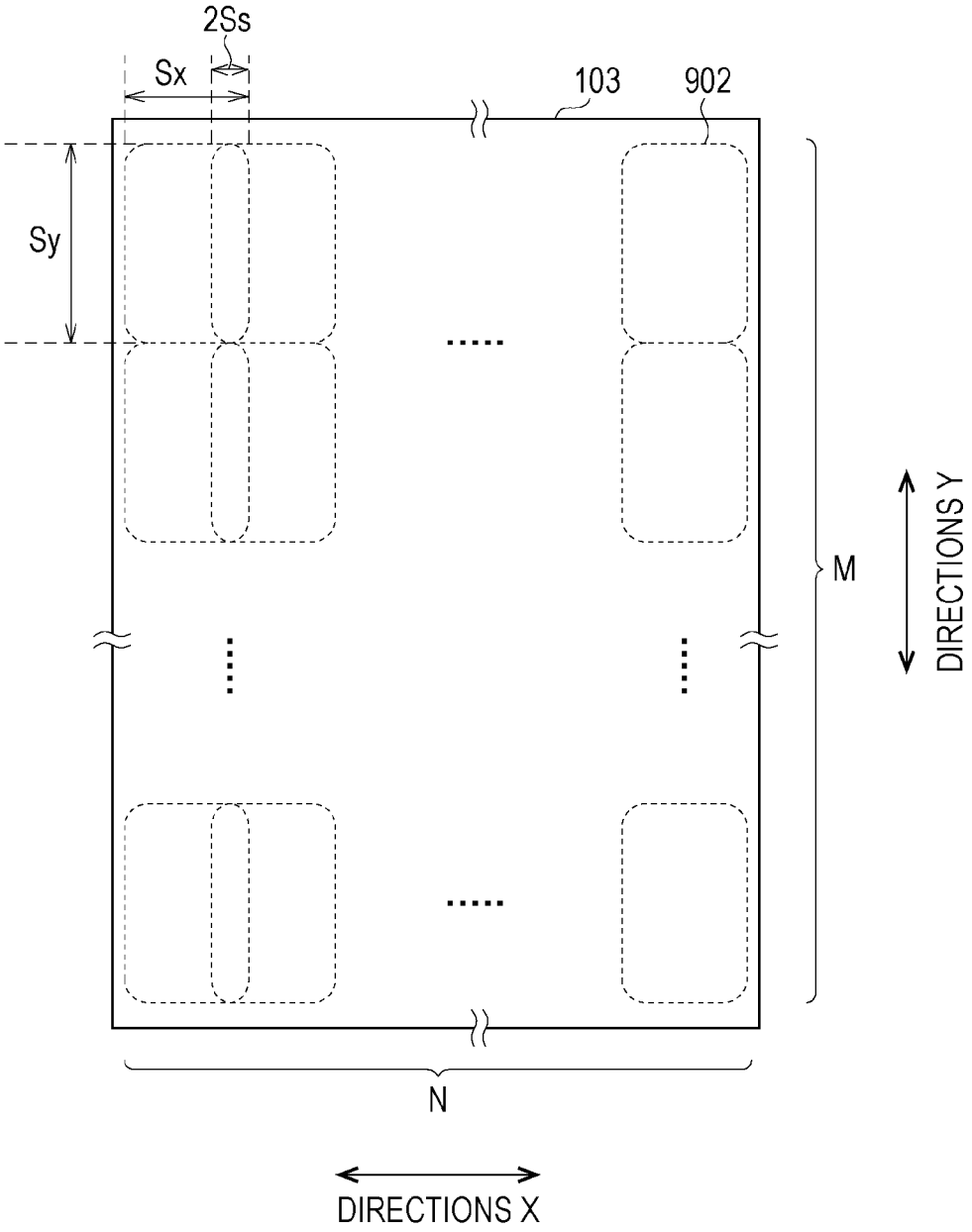
FIG. 7 is a conceptual diagram that shows an arrangement of dot counting blocks on a printing medium according to the inkjet printing apparatus of the first exemplary embodiment.

As shown in FIG. 7, a predetermined printing area is disposed by dividing it into a plurality of dot count blocks (basic unit blocks), which are disposed along the transport direction (the direction Y) and the nozzle-row direction (the direction X). That is, printing data that is printed in the predetermined printing area is divided into a total of M×N dot count blocks, with the number of dot count blocks in the transport direction Y being M and the number of dot count blocks in the nozzle-row direction X being N.

For each dot count block (Sx×Sy), an applying amount D is calculated on the basis of a pixel discharge value in each block. In the first exemplary embodiment, the applying amount D of each dot count block is calculated with a maximum applying amount of each dot count block being 100.

The applying amount D is obtained for each dot count block of its corresponding line head. The dot count blocks are disposed at determined positions on the printing medium. Even if the line heads differ from each other, the dot count blocks are disposed at corresponding positions within the predetermined printing area of the printing medium.

When printing is to be performed such that the predetermined printing area becomes an A4-size printing area, the size of the predetermined printing area is 13440 [dot]/11 inches in the direction Y, and the size of the predetermined printing area is 9600 [dot]/8 inches in the direction X. Therefore, when the predetermined printing area is divided into dot count blocks having a unit size of Sx×Sy=64 [dot]×640 [dot], there are 150 dot count blocks disposed in the X direction and 21 dot count blocks disposed in the direction Y. As a result, a total of 150×21 dot count blocks exist in the predetermined printing area.

In the first exemplary embodiment, the dot count blocks are disposed while the dot count blocks overlap each other by an amount corresponding to 2ss [dot] in the nozzle row direction (the direction of arrangement of the ink discharge ports) X. In addition, although, in the first exemplary embodiment, the dot count blocks are described as not overlapping each other in the transport direction Y, the dot count blocks may be disposed so as to also overlap each other in the transport direction Y.

2-2. Flowchart for Determining Preliminary Discharge Coefficients Dyt and Preliminary Discharge Amounts Dy The process for determining the preliminary discharge amount according to the first exemplary embodiment is hereunder described with reference to FIG. 8.

Figure 8:
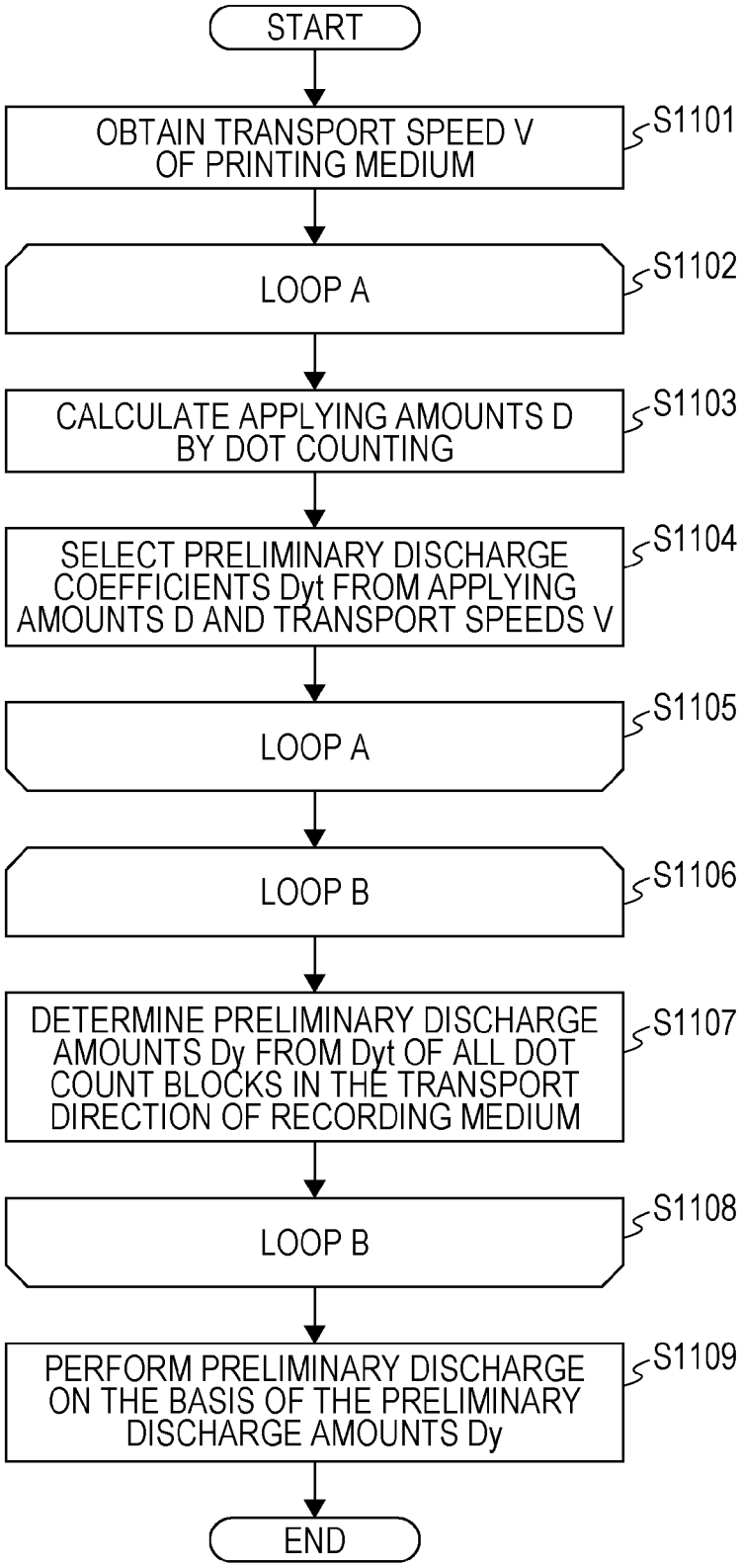
FIG. 8 is a flowchart for determining and providing preliminary discharge amounts of the target head of the inkjet printing apparatus according to the first exemplary embodiment.

FIG. 8 is a flowchart of determining the preliminary discharge amounts of the target head (the line head 206) according to the first exemplary embodiment of the present invention.

I. Step S1101

First, the PC inputs a print instruction. That is, print conditions are received from the PC via the USB controller 305, and, among received pieces of information, the transport speed V [dot/sec] of a printing medium is obtained (calculated) (Step S1101). As print conditions necessary for calculating the transport V, in the first exemplary embodiment, three levels of printing modes, that is, "beautiful", "normal", "fast" are provided. Since predetermined transport speeds are previously set in correspondence with these printing modes, the transport speed V is obtained in accordance with the printing mode.

II. Steps S1102 to S1105 (Loops A)

Next, before image data is received from the PC via the USB controller 305, and is transmitted to the head driver 308 by the ASIC 306, the ASIC 306 (count unit) counts the number of discharges from the printing head 101 (that is, counts the number of dots). In other words, in the ASIC 306, the dot count is performed to count all of the dot count blocks of all of the upstream heads (that is, Step S1102 to Step S1105 are repeated, that is, the steps from a loop A to a loop A are repeated).

II-I. Step S1103

The procedure (Step S1103) for calculating the applying amounts D is hereunder described with reference to FIG. 9.

Figure 9:
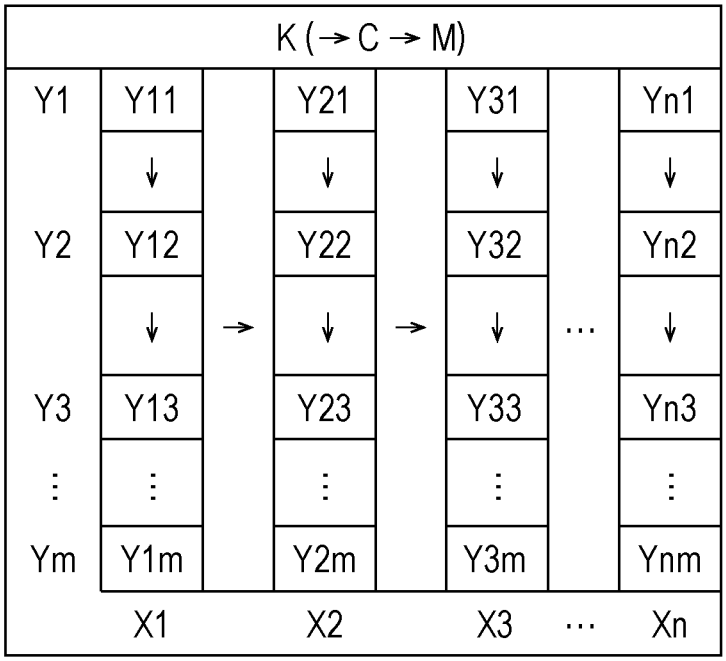
FIG. 9 is a conceptual view showing the procedure for calculating the applying amount of each upstream head of the inkjet printing apparatus according to the first exemplary embodiment.

As shown in FIG. 9, first, of the upstream heads (203, 204, and 205), the nozzles of the line head 203 (the K line head) are separated as n number of processing unit blocks 901 (see FIG. 6) so that the processing unit blocks 901 become X1th, X2th, . . . Xnth processing unit blocks in the nozzle row direction X.

Dot applying amounts D (Y11, Y12, . . . Y1*m*) are calculated for the M number of (see FIG. 7) dot count blocks (Y1th, Y2th, . . . Ymth dot count blocks), which exist in the predetermined printing area in the transport direction Y, in correspondence with the X1th processing unit block 901.

Similarly, applying amounts D (Yn1, Yn2, . . . Ynm) for the X2th, X3th, . . . Xnth processing unit blocks 901 following the X1th processing unit block in the nozzle row direction are calculated as for the X1th processing unit block 901.

Even for the line head 204 (the C line head) and the line head 205 (the M line head) following the K line head, as with the K line head, the applying amounts D of all of the dot count blocks related to these upstream heads are calculated.

If the M number of dot count blocks (Y1th, Y2th, . . . Ymth dot count blocks), which exist in the predetermined printing area in the transport direction Y, are defined as one aggregate (column unit block) in correspondence with the predetermined processing unit block 901, the calculation of the applying amounts D is facilitated. That is, a predetermined printing area is divided into a plurality of column unit blocks that are arranged in the direction X that intersects the transport direction Y, and the applying amounts D of the respective column unit blocks of each upstream head are calculated.

II-II. Step S1104

After calculating the applying amounts D of the dot count blocks (or the column unit blocks), on the basis of the printing-medium transport speed V obtained in Step S1101 and the applying amounts D, preliminary discharge coefficients Dyt are selected from the preliminary discharge coefficient table shown in FIG. 10 (Step S1105). In this way, the preliminary discharge coefficients Dyt are determined for all of the dot count blocks (or the column unit blocks). Although FIG. 10 shows an example of the preliminary discharge coefficient table, the setting of the preliminary discharge coefficient table may be changed as appropriate.

As can be understood from the preliminary discharge coefficient table shown in FIG. 10, the larger the applying amounts of the upstream heads, the smaller the values of the preliminary discharge coefficients Dyt (the preliminary discharge amounts Dy) that are set. That is, it is possible to set the ink discharge amount of a preliminary discharging operation of the downstream head smaller when the ink discharge amounts in printing operations (the first printing operations) of the upstream heads are greater than or equal to a predetermined amount than when the ink discharge amounts in the first printing operations are less than the predetermined amount. Therefore, it is possible to reduce the consumption of ink.

The higher the transport speed V, that is, the shorter the elapsed time, the smaller the value of the preliminary discharge coefficient Dyt (the preliminary discharge amount Dy). In other words, the preliminary discharge amount Dy when the transport speed V is less than a threshold value can be set larger than the preliminary discharge amount Dy when the transport speed V is greater than or equal to the threshold value. That is, the preliminary discharge amount Dy when the transport speed V is greater than or equal to the threshold value can be set smaller than the preliminary discharge amount Dy when the transport speed V is less than the threshold value.

When the applying amounts of the upstream heads are less than or equal to a predetermined value (for example, less than 40 in the first exemplary embodiment), since a humidification effect cannot be expected, the preliminary discharge coefficients are set to a maximum value (MAX). That is, when a humidification effect cannot be expected from the applying amounts of the upstream heads, the maximum preliminary discharge amount (preliminary discharge coefficient) is set so that changes in conditions such as the physical properties of ink and temperature and humidity of the ambient environment can be sufficiently handled.

In the first exemplary embodiment, the transport speed V is 3600 [dot/sec], and the upper limit of the applying amounts in a predetermined printing area is 100. For example, the preliminary discharge coefficient Dyt that can be obtained from a certain dot count block when the applying amount is 70 (from 60 to less than 80) is 12 [dot]. When the applying amount D is less than the predetermined value (less than 40 in the first exemplary embodiment) (for example, when the case corresponds to the case of blank data), the preliminary discharge coefficient is set to the maximum value (MAX) of 18 [dot].

In the first exemplary embodiment, the preliminary discharge coefficients Dyt are set on the basis of the transport speed V. The elapsed time up to when the print images 401 are transported to the portion opposing the target head after the print images 401 have been printed by the upstream heads is related to the preliminary discharge coefficients Dyt (see FIG. 5). Therefore, the preliminary discharge coefficients Dyt are set on the basis of the applying amounts D of the upstream heads and the elapsed time.

The elapsed time may be calculated (estimated) indirectly on the basis of the transport speed V and the distance between the second printing head and each first printing head. Alternatively, using, for example, a timer for controlling time, the elapsed time may be directly measured. Still alternatively, it is possible to estimate a movement distance by counting the number of slits of an encoder in a unit time, and indirectly calculate the elapsed time along with the transport speed V. Still alternatively, it is possible to indirectly calculate the elapsed time from the total wait time and a transport time that is previously set for each printing mode.

The preliminary discharge amounts Dy when the elapsed time is greater than or equal to a threshold value can be set larger than the preliminary discharge amounts Dy when the elapsed time is less than the threshold value. That is, the preliminary discharge amounts Dy when the elapsed time is less than the threshold value can be set smaller than the preliminary discharge amounts when the elapsed time is greater than or equal to the threshold value.

III. Step S1106 to Step S1108 (Loops B)

After determining the preliminary discharge coefficients Dyt for the dot count blocks of all of the upstream heads in Step S1102 to Step S1105, the preliminary discharge amounts Dy are determined (Step S1106 to Step S1108). That is, for each size Sc [dot] of the processing unit blocks 901 that determine the preliminary discharge amounts in the nozzle row direction X, the preliminary discharge amounts Dy of the nozzles of the N number of processing unit blocks of the target head 206 (X1th, X2th, . . . Xnth processing unit blocks) are determined. The method for determining the preliminary discharge amounts Dy of the target head 206 on the basis of the preliminary discharge coefficients Dyt is described in detail in section 2-3.

IV. Step S1109

After completing all of the data processing operations and determining the preliminary discharge amounts Dy of the target head, the inkjet printing apparatus 1 starts printing an image. After printing the image by the printing head 101, the target head performs a preliminary discharging operation on a non-image formation area of a printing medium in accordance with the preliminary discharge amounts Dy determined in Step S1106 to Step S1108 (Step S1109). In the first exemplary embodiment, the upstream heads 203 to 205 other than the target head (the downstream head 206) perform preliminary discharging operations of a predetermined preliminary discharge amount.

Figure 11:
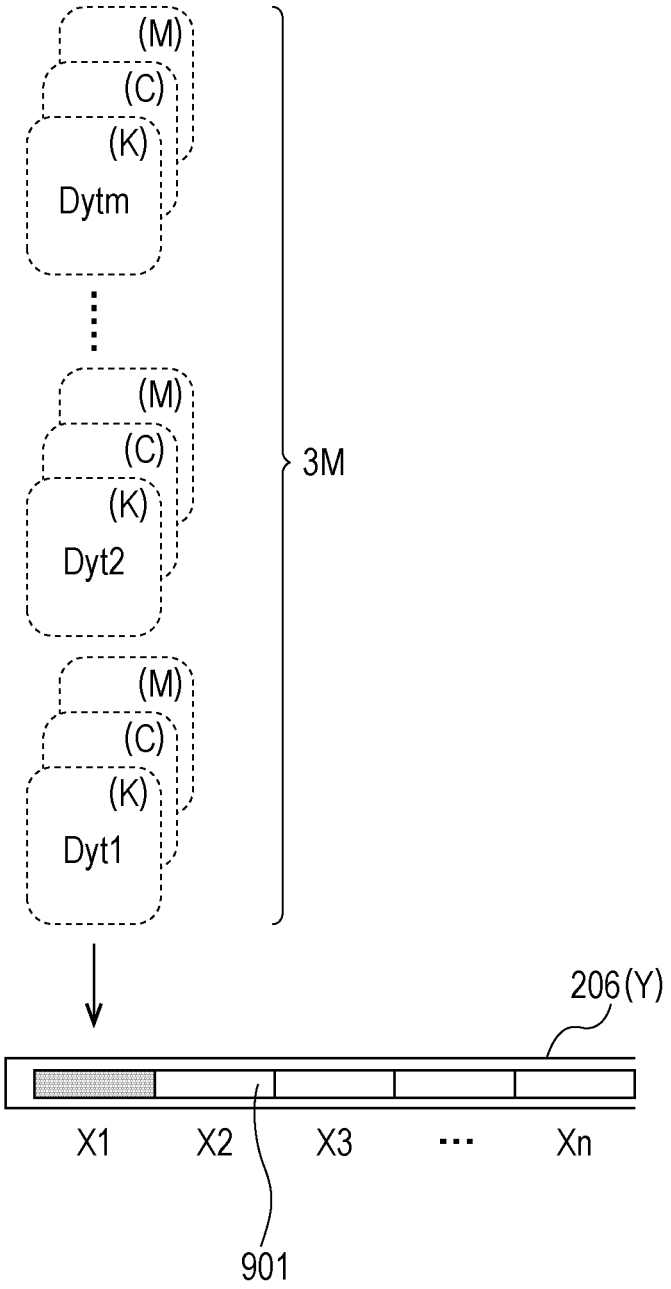
FIG. 11 is a schematic view for determining the preliminary discharge amounts on the basis of the preliminary discharge coefficients of the inkjet printing apparatus according to the first exemplary embodiment.

2-3. Example of Determining Preliminary Discharge Amounts Dy on the Basis of Preliminary Discharge Coefficients Dyt FIG. 11 is a schematic view for determining the preliminary discharge amounts Dy on the basis of the preliminary discharge coefficients Dyt. FIG. 11 shows the correlation between a nozzle of one processing unit block 901 (such as the X1th processing unit block) along the nozzle arrangement direction X of the target head 206 and the preliminary discharge coefficients Dyt corresponding to the dot count blocks (the column unit blocks) of the upstream heads. On the basis of this correlation, the preliminary discharge amount Dy of the X1th processing unit block 901 is determined. Similarly the preliminary discharge amounts Dy of the X2th to Xnth processing unit blocks 91 are successively determined.

A description is given focusing on the nozzle of one processing unit block 901 (such as the X1th processing unit block) of the target head 206 (the Y head). At an upstream head (such as the K head) that is positioned upstream from the target head 206 (the Y head), the M number of dot count blocks (or one column unit block) pass a discharge port surface (a front surface) of the processing unit block in the transport direction Y.

When the number of upstream heads is three (K, C, and M heads), the 3M number of dot count blocks (or three column unit blocks) pass the discharge port surface of the processing unit block. Therefore, in determining the preliminary discharge amount Dy of the nozzle of the X1th processing unit block 901 of the target head 206 (Y head), it is necessary to consider the influence of the evaporation of moisture from the 3M number of dot count blocks (or the three column unit blocks). Therefore, using 3M number of preliminary discharge coefficients (Dyt1, Dyt2, . . . , Dytm×3) determined in Steps S1102 to S1105, the preliminary discharge amount Dy of the nozzle corresponding to the X1th processing unit block 901 is determined. The preliminary discharge amounts Dy of the X2th to Xnth processing unit blocks 901 are successively determined using the same procedure as that used for the X1th processing unit block 901.

In this way, in the first exemplary embodiment, the controller (the preliminary discharge controller) determines the preliminary discharge amounts of the preliminary discharging operation of the downstream head (the second printing head) on the basis of the applying amounts (the ink discharge amounts) of the printing operations of the upstream heads (the first printing heads).

2-4. Correction of Preliminary Discharge Coefficients Dyt

Although, as mentioned above, it is possible to easily obtain the preliminary discharge coefficients Dyt (the preliminary discharge amounts Dy) on the basis of the transport speed V and the applying amounts D, the intervals (the distances) between the line heads 203 to 205, which are the upstream heads, are not considered. That is, it is presupposed that each of the upstream line heads 203 to 205 and the downstream line head 206 are separated from each other by the same distance. Correction of the preliminary discharge coefficients Dyt (the preliminary discharge amounts Dy) of the downstream line head 206 is hereunder described while considering the intervals (the distances) between the upstream line heads 203 to 205.

Figure 12:
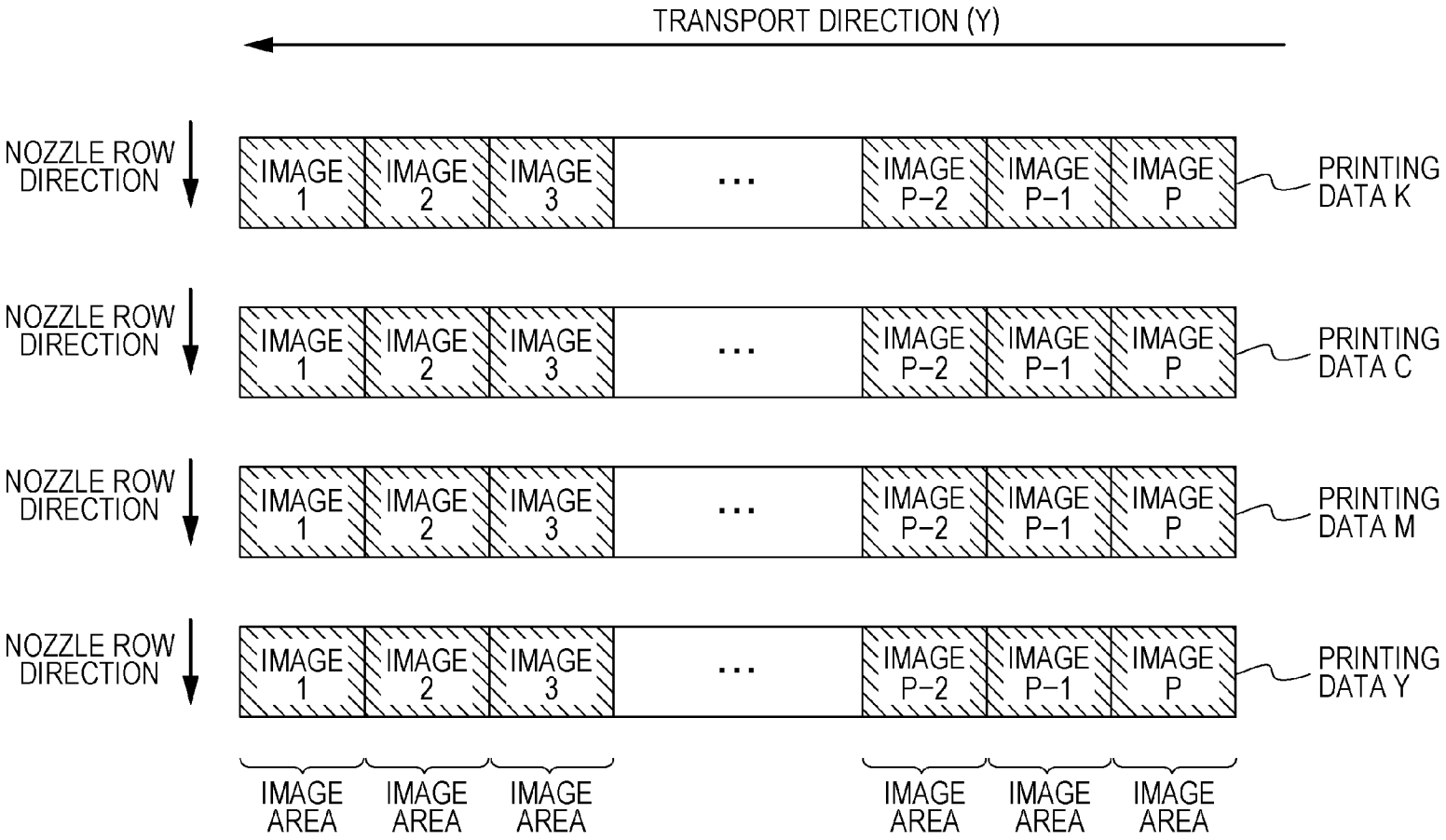
FIG. 12 is a schematic view of arrays of printing data of images to be printed by respective line heads (K, C, M, and Y line heads) of the inkjet printing apparatus according to the first exemplary embodiment.

I. Relationship Between Printing Data Shifting Amount and Interval Between Line Heads FIG. 12 is a schematic view of arrays of printing data of images to be printed by the respective line heads (K, C, M, and Y line heads). The pieces of printing data are pieces of data that have been quantized by a predetermined image processing operation performed on the pieces of image data. Information regarding "printing (1)" or "non-printing (2)" of dots with respect to individual pixels is set.

As shown in FIG. 12, the heads of the respective colors (K, C, M, and Y) print images 1 to P in that order, and, as shown in FIG. 4, the line heads 203 to 206 take turns printing the images (that is, in order of the K head, the C head, the M head, and the Y head). That is, after the line head 203 has printed the image 1, the line head 204, the line head 205, and the line head 206 take turns printing the images 1 in that order, and the printing of the images 1 is finally completed. In FIG. 12, non-image areas between image areas (such as the non-image areas between the images 1 and the respective images 2) are not shown. The preliminary discharging operations according to the first exemplary embodiment are performed on the non-image areas between the corresponding image areas.

Since the line heads are disposed apart from each other in the printing-medium transport direction Y, corresponding images cannot be formed at the same discharge timing. Conversely, when images are formed at the same discharge timing, the formed images are shifted from each other. Therefore, in the first exemplary embodiment, two adjacent line heads are disposed apart from each other by the predetermined distance L. Consequently, it is necessary to adjust (correct) the discharge timing by shifting the pieces of printing data by an amount corresponding to the distance L. The discharge timing adjustment may hereunder be called shifting of printing data.

Figure 13:
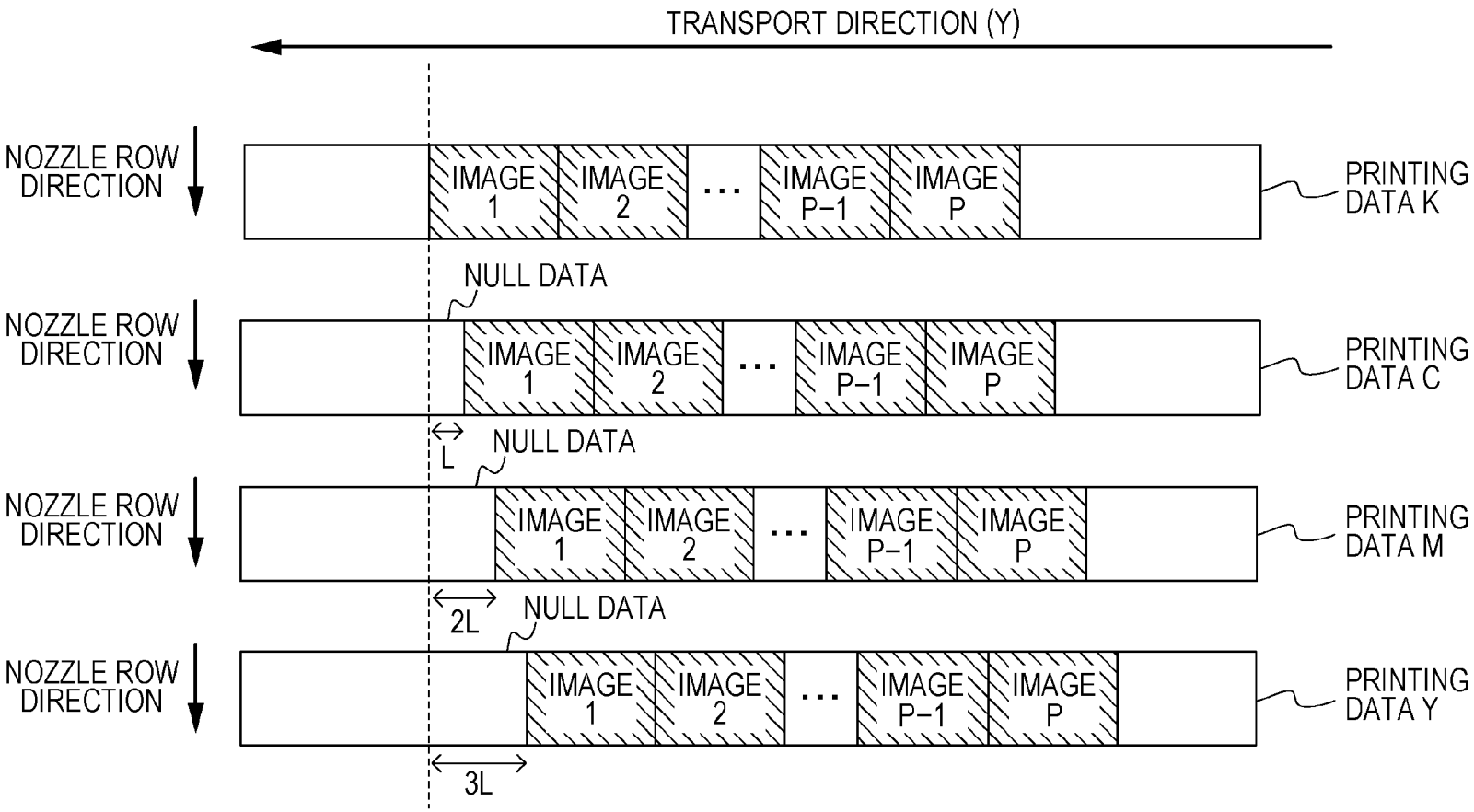
FIG. 13 is a schematic view of pieces of printing data of the respective line heads corrected on the basis of the arrangement of the line heads of the inkjet printing apparatus according to the first exemplary embodiment.

FIG. 13 is a schematic view of the pieces of printing data of the respective line heads 203 to 206 to which pieces of null data are added for correcting the discharge timings on the basis of the arrangement of the line heads. That is, with reference to printing data K, pieces of printing data C, M, and Y are corrected. Correction amounts (pieces of null data) corresponding to a multiple of the predetermined distance L between the line heads are added to positions that precede the images 1 printed by the respective line heads 204 to 206.

By adding the null data corresponding to the predetermined L to the position that precedes the image 1 in the printing data C of the line head 204, the shift of the printing position between the line heads 203 and 204 can be adjusted (corrected) using the null data. Similarly, by adding the null data corresponding to a predetermined distance 2 L to the position that precedes the image 1 in the printing data M of the line head 205, the shift of the printing position between the line heads can be adjusted (corrected) using the null data. By adding the null data corresponding to a predetermined distance L3 to the position that precedes the image 1 in the printing data Y of the line head 206, the shift of the printing position between the line heads can be adjusted (corrected) by using the null data.

As described above, by previously adding the predetermined pieces of null data to pieces of printing data, it is possible to adjust the discharge timings of ink for the line heads and to align the printing positions on a printing medium. The pieces of null data are added to the pieces of printing data by the CPU 302.

Figure 14:
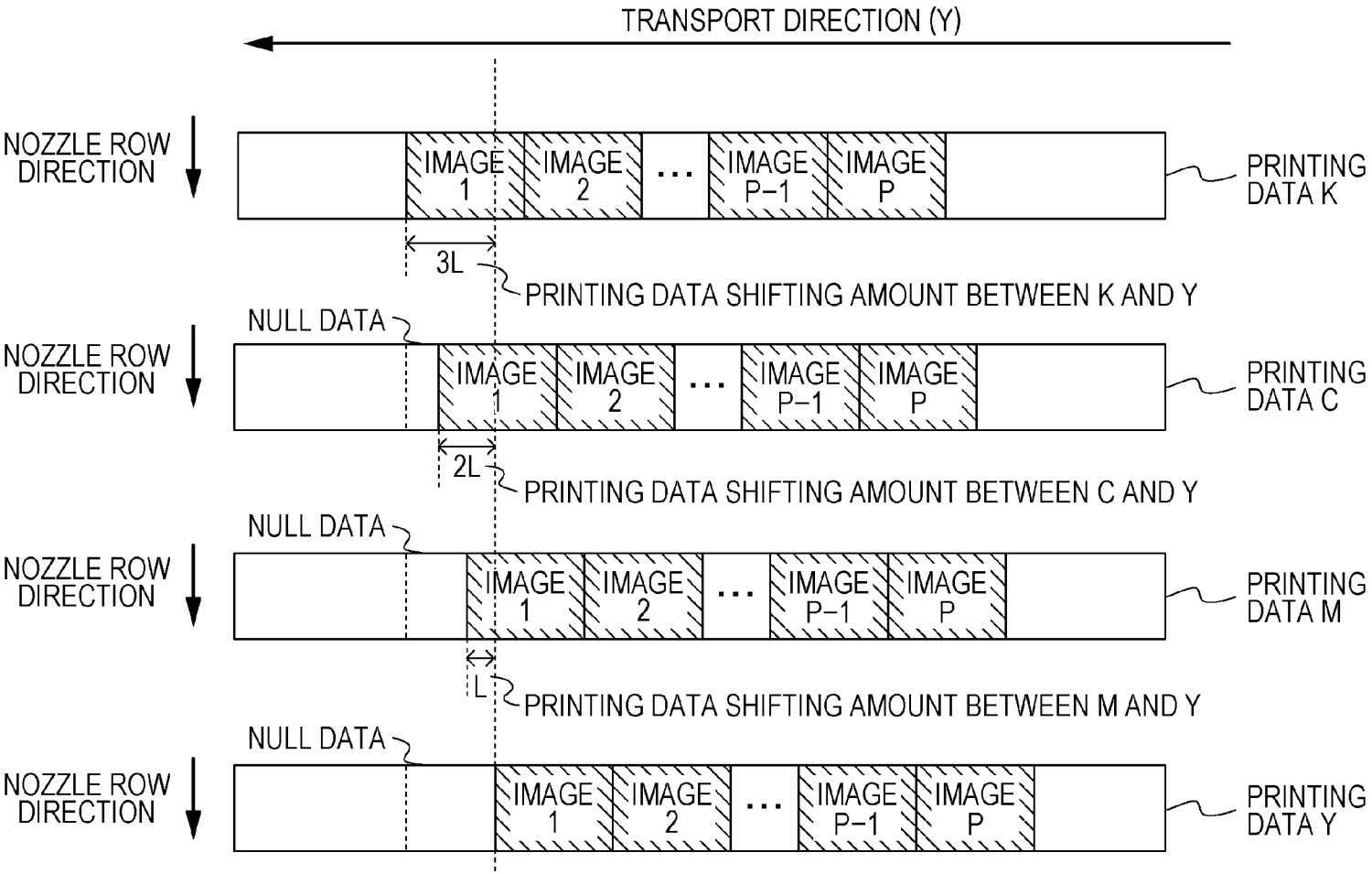
FIG. 14 is a schematic view of printing-data shifting amount between printing data K and printing data Y, printing-data shifting amount between printing data C and the printing data Y, and printing-data shifting amount between printing data M and the printing data Y, with the printing data Y of the target head of the inkjet printing apparatus according to the first exemplary embodiment and serving as a reference.

FIG. 14 shows the printing-data shifting amount between the printing data K and the printing data Y, the printing-data shifting amount between the printing data C and the printing data Y, and the printing-data shifting amount between the printing data M and the printing data Y. As can be understood from FIG. 14, with the leading image 1 to be printed by the target head serving as a reference, the printing-data shifting amounts corresponding to the distances 3L, 2L, and L exist at the locations that precedes the images 1 to be printed by the upstream heads (the line heads 203 to 205), respectively.

II. Correction of Preliminary Discharge Coefficients Dyt on the Basis of Data Shifting Amounts In determining the preliminary discharge amounts Dy of the target head, it is possible to correct the preliminary discharge coefficients Dyt on the basis of the positional relationship between the target head and each of the upstream heads (data shifting amounts). That is, as shown in FIG. 14, the elapsed time up to when the print images 401 reach the target head 206 after the upstream heads have performed printing differs for each of the upstream heads 203 to 205. With the applying amounts being the same, the smaller the printing-data shifting amount, that is, the shorter the elapsed time, the higher the humidification effect. Therefore, the preliminary discharge amounts Dy can be set small by correcting the preliminary discharge coefficients in accordance with the data shifting amounts.

Figure 15:
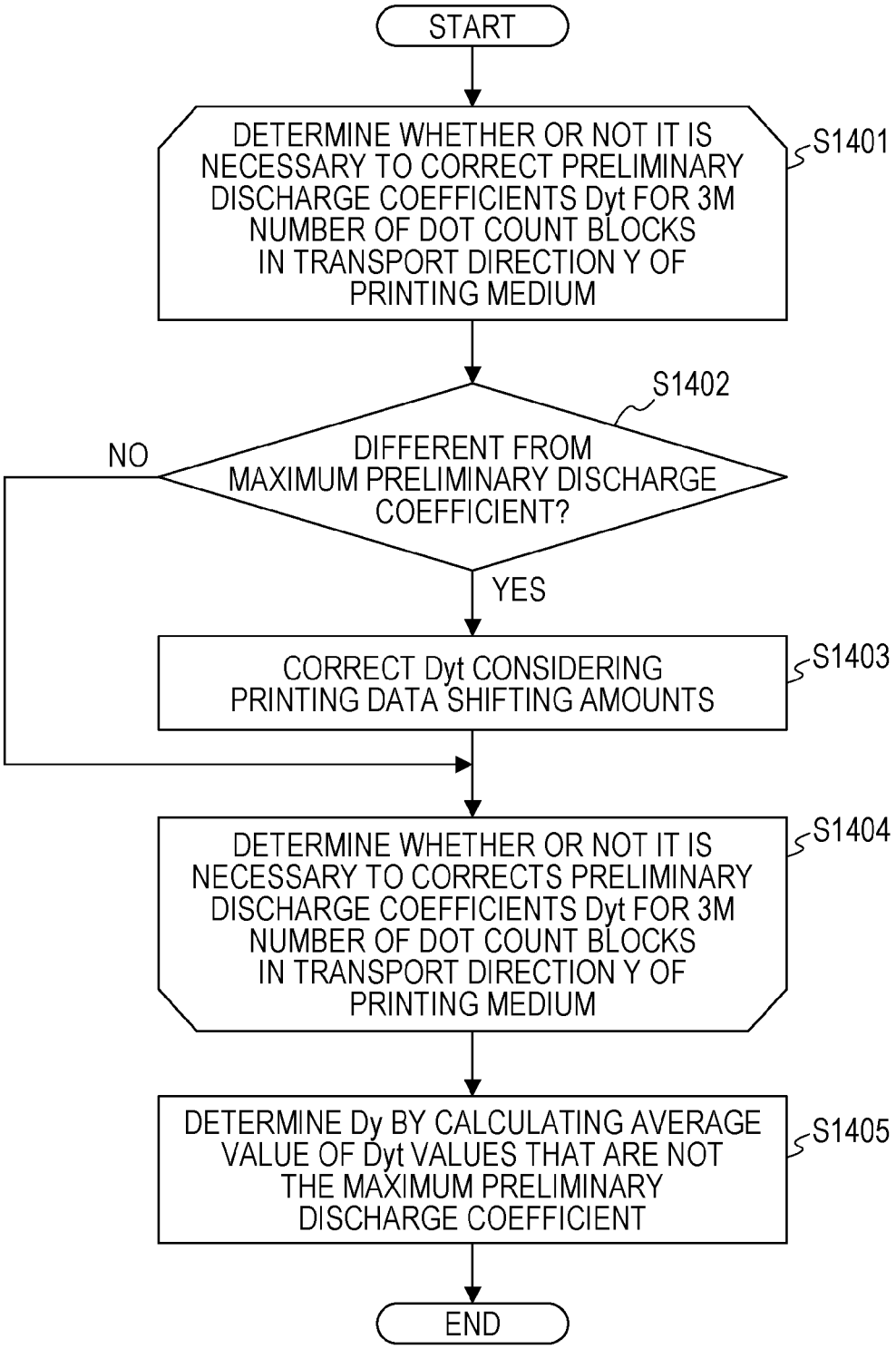
FIG. 15 is a flowchart for correcting the preliminary discharge coefficients on the basis of the printing-data shifting amounts of the inkjet printing apparatus according to the first exemplary embodiment.

FIG. 15 is a flowchart for correcting the preliminary discharge coefficients Dyt.

In the first exemplary embodiment, as shown in FIG. 15, it is determined whether or not it is necessary to correct all of the preliminary discharge coefficients Dyt (determined in Step S1107 in FIG. 8), and, if correction is required, correction control is performed (Steps S1401 to S1404).

First, it is determined whether or not the preliminary discharge coefficients Dyt differ from the set maximum preliminary discharge coefficient (MAX) (Step S1402). If the preliminary discharge coefficients Dyt are equal to the maximum preliminary discharge coefficient, the applying amounts D of the upstream heads are less than or equal to a predetermined amount. Therefore, it is determined that they do not contribute to humidifying the target head, as a result of which the preliminary discharge coefficients Dyt calculated in Step S1107 are not corrected. That is, correction that reduces the preliminary discharge amounts that are being used is not performed.

In contrast, if the preliminary discharge coefficients Dyt differ from the maximum preliminary discharge coefficient, the applying amounts D of the upstream heads are greater than or equal to the predetermined amount. Therefore, it is determined that they contribute to humidifying the target head, as a result of which the preliminary discharge coefficients Dyt calculated in Step S1107 are more precisely corrected by further adding the pieces of printing-data shifting amounts (Step S1403).

More specifically, correction values corresponding to the printing-data shifting amounts are previously calculated on the basis of experiments, and a correction table is formed. FIG. 16 is a table of correction values of the preliminary discharge coefficients Dyt corresponding to the printing data shifting amounts according to the first exemplary embodiment. In the first exemplary embodiment, since the distance between the line heads is L=1920 [dot], the printing data shifting amount between the line head 206 (the Y head), which is the target head, and the line head 203 (the K head), which is an upstream head, is 3L=5760 [dot]. Similarly, the printing data shifting amount between the line head 206 (the Y head) and the line head 204 (the C head) is 2L=3840 [dot]. The printing data shifting amount between the line head 206 (the Y head) and the line head 205 (the M head) is L=1920 [dot]. From the correction table, the correction values corresponding to the printing data shifting amounts are selected to correct the preliminary discharge coefficients Dyt.

Of the corrected preliminary discharge coefficients Dyt obtained in Step S1403, the average value of all of the preliminary discharge coefficients Dyt that are not equal to the maximum preliminary discharge coefficient (MAX) is further calculated to determine the preliminary discharge amounts Dy (Step S1405).

FIG. 17 shows an example of correcting the preliminary discharge coefficients Dyt of certain processing unit blocks using the correction table shown in FIG. 16 (that is, the relationship before and after the correction). The table on the left in FIG. 17 shows the preliminary discharge coefficients Dyt determined on the basis of the applying amounts D and the transport speed V. By adding, in accordance with the correction table shown in FIG. 16, the correction values to the preliminary discharge coefficients Dyt that are not equal to the maximum preliminary discharge coefficient (MAX) in the table on the left shown in FIG. 17, the corrected preliminary discharge coefficients Dyt shown in the table on the right in FIG. 17 can be obtained. In addition, the average value of the corrected preliminary discharge coefficients Dyt that are in the table on the right in FIG. 17 and that are not equal to the maximum preliminary discharge coefficient (MAX) is calculated. When the result of calculation is not an integer, it is possible to round up the fractional portion of the number. For example, the average value of the preliminary discharge coefficients Dyt of the processing unit blocks 901 calculated on the basis of the table on the right in FIG. 17 in the first exemplary embodiment (that is, the preliminary discharge amount Dy) is 10.32. When the fractional portion of this number is rounded up, the preliminary discharge amount Dy becomes 11.

By repeating the aforementioned operations, the preliminary discharge coefficients Dyt of all of the processing unit blocks 901 (X1th, X2th, . . . , Xnth processing unit blocks) of the target head 206 are corrected. Then, on the basis of the corrected preliminary discharge coefficients Dyt, the final preliminary discharge amounts Dy are determined.

In the first exemplary embodiment, the line head 206 is the target head (the second printing head) and the line heads 203 to 205 (the first printing heads) are the upstream heads. However, it goes without saying that, of the upstream heads 203 to 205, a line head disposed on a more downstream side, such as the line head 205, may be a new target head and the line heads 203 and 204 may be the upstream heads, in which case the preliminary discharge amounts of the line head 205 is determined.

As described above, in the first exemplary embodiment of the present invention, by determining the preliminary discharge amounts of the downstream head while considering the humidification effect resulting from printing by the upstream heads in the transport direction Y, it is possible to prevent unnecessary preliminary discharges, so that excess preliminary discharge ink can be reduced. That is, it is possible to optimize the preliminary discharge amounts of the target head while considering the humidification effects corresponding to the applying amounts of the upstream heads. As a result, the amount of ink that is consumed in the preliminary discharge is reduced. If humidification effects based on the applying amounts of the upstream heads cannot be expected, it is possible to maximally recover the target head from its discharging failure state by setting the preliminary discharge amounts to the maximum preliminary discharge amount.

Second Exemplary Embodiment

The structure according to a second exemplary embodiment of the present invention is basically the same as the structure according to the first exemplary embodiment. The differences from the first exemplary embodiment are described below.

In the above-described first exemplary embodiment, in Step S1405, the preliminary discharge amounts Dy are determined from the average value of all of the corrected preliminary discharge coefficients Dyt that are not equal to the maximum preliminary discharge coefficient and that have been calculated in Step S1403 (see FIG. 15). In contrast, in the second exemplary embodiment, in calculating (determining) the preliminary discharge amounts Dy by averaging the preliminary discharge coefficients Dyt, the preliminary discharge amounts Dy are further corrected in accordance with the total number of dot count blocks that contribute to humidification.

More specifically, after temporarily calculating the average value of all of the corrected preliminary discharge coefficients Dyt that are not equal to the maximum preliminary discharge coefficient (MAX) and that have been calculated in Step S1403, a correction coefficient that is in accordance with the number of preliminary discharge coefficients is reflected (multiplied), to determine the final preliminary discharge amounts Dy.

FIG. 18 is a table of correction values corresponding to the number of dot count blocks that contribute to humidification in the second exemplary embodiment. As shown in FIG. 18, the number of dot count blocks that contribute to humidification is divided into a plurality of levels. The correction values corresponding to these levels are set. By further multiplying the correction value to the average value of the preliminary discharge coefficients Dyt excluding those that are equal to the maximum preliminary discharge coefficient, it is possible to perform control such that as the number of effective blocks is increased, a higher humidification effect can be expected and the preliminary discharge amounts Dy are gradually reduced. That is, the preliminary discharge amounts Dy can be determined (corrected) in accordance with the number of dot count blocks.

Figure 19:
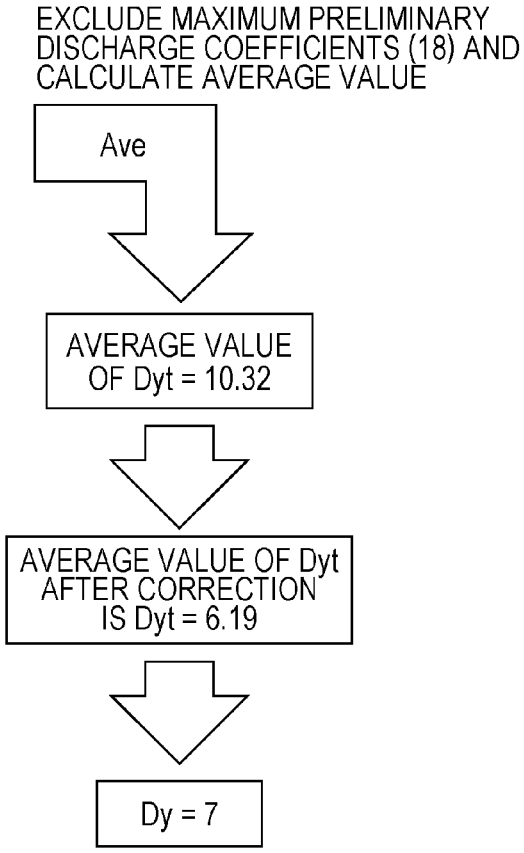
FIG. 19 is a specific example of calculating a preliminary discharge amount of the inkjet printing apparatus according to the second exemplary embodiment.

FIG. 19 is a specific example of calculating a preliminary discharge amount Dy. On the basis of the number of blocks for the preliminary discharge coefficients Dyt (where the applying amounts D are greater than or equal to a threshold value) that are not equal to the maximum preliminary discharge coefficient MAX) among the corrected preliminary discharge coefficients Dyt, the correction value (0.6 in the first exemplary embodiment) is selected from the table of correction values in FIG. 18. An average value Dyt of the preliminary discharge coefficients Dyt to which the correction value has been multiplied is 6.19. When the result of calculation includes digits to the right of a decimal, as mentioned above, it is possible to round up the fractional portion of the number. Therefore, in the second exemplary embodiment, the preliminary discharge amount Dy of a certain processing unit block that determines the preliminary discharge amount is 7.

Accordingly, in the second exemplary embodiment of the present invention, the controller obtains the preliminary discharge amount Dy of a downstream head on the basis of applying amounts D of upstream heads that have been calculated by a count unit and the number of dot count blocks in which the applying amounts D of the upstream heads are greater than or equal to a predetermined threshold value.

As a method for determining the preliminary discharge amounts Dy on the basis of the preliminary discharge coefficients Dyt, it is possible to use an equalization method as in the first exemplary embodiment, or a correction method for correcting preliminary discharge coefficients while considering the total number of effective dot count blocks as in the second exemplary embodiment. It is also possible to determine the preliminary discharge amounts Dy only on the basis of the number of dot count blocks whose preliminary discharge coefficients Dyt are greater than or equal to a threshold value.

Third Exemplary Embodiment

A structure according to a third exemplary embodiment of the present invention is basically the same as those according to the first and second exemplary embodiments. The differences are hereunder described.

In the foregoing exemplary embodiments, the method for directly determining the preliminary discharge amounts of a downstream head on the basis of the applying amounts of the upstream heads is described. In the third exemplary embodiment of the present invention, preliminary discharge amounts of heads are previously set as predetermined amounts in accordance with a required printable time, humidifying actions resulting from the applying amounts of upstream heads are considered, and the preliminary discharge amounts are adjusted by subtracting an amount corresponding to a humidification effect from the predetermined amounts.

That is, in the third exemplary embodiment according to the present invention, a controller temporarily sets, as predetermined amounts, ink discharge amounts of a preliminary discharging operation that do not contribute to a printing operation by a downstream head. Then, the predetermined amounts are adjusted on the basis of ink discharge amounts of printing operations by the upstream heads. Further, the preliminary discharging operation at the downstream head is executed on the basis of the adjusted ink discharge amounts.

The controller according to the third exemplary embodiment forms a preliminary discharge amount temporary setting unit, a preliminary discharge amount adjusting unit, and a preliminary discharge controller.

Figure 20:
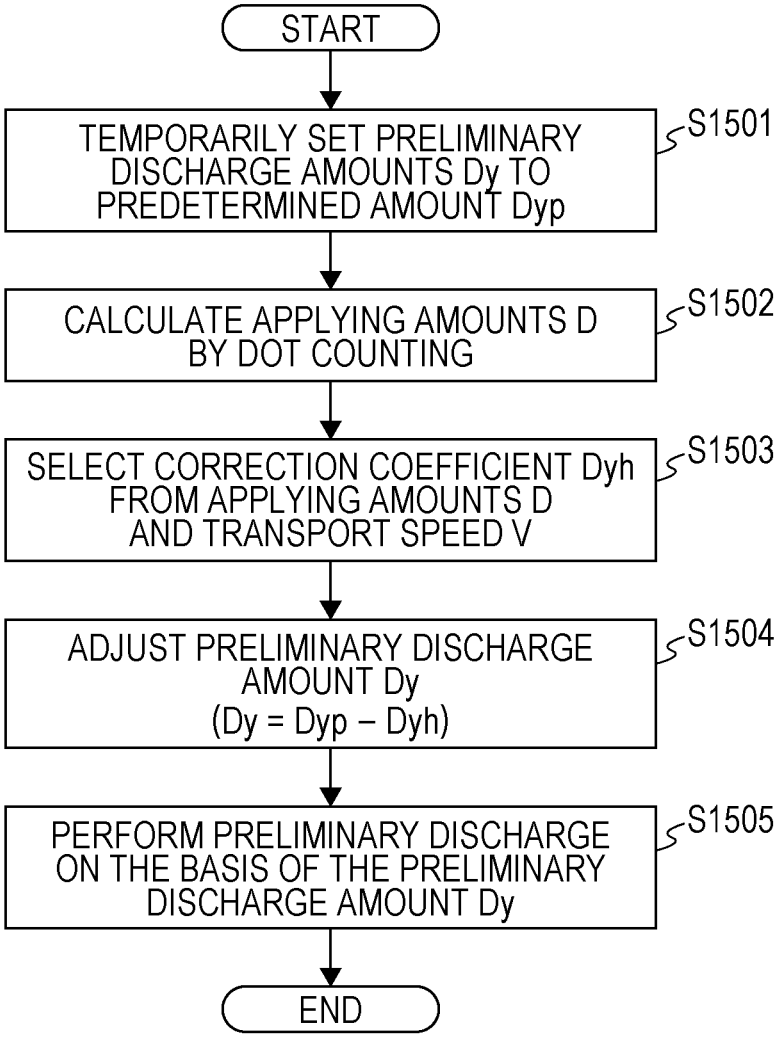
FIG. 20 is a flowchart for determining a preliminary discharge amount according to a third exemplary embodiment.

A method for determining the preliminary discharge amounts of a downstream head according to the third exemplary embodiment is hereunder described in detail with reference to FIG. 20. FIG. 20 is a flowchart of a control process according to the third exemplary embodiment.

First, a preliminary discharge amount of a line head 206 (a downstream head) is temporarily set as a predetermined amount Dyp (Step S1501). Then, applying amounts D of line heads 203 to 205 (upstream heads) are calculated (Step S1502). On the basis of the calculated applying amounts D and a transport speed V of a transporting unit, a correction coefficient Dyh is selected from a table previously provided on the basis of, for example, experimental results (Step S1503). Next, a preliminary discharge amount Dy is corrected by subtracting the correction coefficient Dyh from the temporarily set predetermined amount Dyp (Step S1504). Although, in the third exemplary embodiment, the preliminary discharge amount Dy is corrected by subtracting the correction coefficient Dyh from the predetermined amount Dyp, it is possible to correct the preliminary discharge amount Dy by multiplying a predetermined multiplier to the predetermined amount Dyp. Lastly, the downstream head performs preliminary discharge on the basis of the corrected preliminary discharge amount Dy.

Others

In the foregoing exemplary embodiments, the Step S1109 for performing preliminary discharge using the printing head 101 is controlled so as to be performed between images (that is, an area other than a print image area of a printing medium). However, the Step S1109 may be controlled such that the preliminary discharge (sheet preliminary discharge) is performed in a print image area of a printing medium instead of a location between images. Although, in general, the sheet preliminary discharge is performed with a predetermined time interval and a predetermined ink discharge amount, the preliminary discharge amount and the interval between sheet preliminary discharges at the downstream head may be corrected on the basis of, for example, the applying amounts D of the upstream heads. That is, the preliminary discharge may be controlled such that the interval between preliminary discharges at the downstream head is increased or the preliminary discharge amount is reduced in correspondence with the humidification effects provided by the upstream heads.

The sheet preliminary discharge is performed by controlling the preliminary discharge amounts with nozzles being provided as a plurality of areas (X1, X2, . . . , Xn) in a nozzle row direction X. However, density unevenness caused by variations in preliminary discharge amounts occurs at the nozzles of respective separated processing unit blocks. Therefore, the preliminary discharge amounts may be determined so as to be small in areas other than areas where the preliminary discharge amounts are a maximum. In contrast, when the density unevenness does not exceed an allowable range, the preliminary discharge amounts may be determined for respective dot count blocks in a predetermined printing area.

In the above-described exemplary embodiments, it is assumed that, when determining the preliminary discharge amounts Dy of the target head, the contributions of the dot count blocks of all of the upstream heads to humidifying the downstream head are the same (that is, how effectively they humidify the downstream head is the same), to simplify the method for determining the preliminary discharge amounts Dy. However, the humidification effects of the dot count blocks of the upstream heads on the target head are reduced (that is, the humidification becomes less effective) as time passes from when the effects occur. In other words, until the target head is actually humidified from when the humidification effects occur, the effectiveness of the humidification is reduced as time passes. Therefore, it is possible to further correct the preliminary discharge amounts of the target head while considering the elapsed time from when the humidification effect of each dot count block occurs to when the dot count blocks move to a location opposing the target head and the target head is humidified. In other words, the dot count blocks that are positioned more downstream in the transport direction take less time to reach the portion opposing the target head 206 from the start of a printing operation on a predetermined printing area by the printing head 101, so that a reduction in the humidification effects provided on the basis of the dot count blocks that are positioned more downstream in the transport direction is smaller. Therefore, the preliminary discharge amounts Dy may be corrected such that the preliminary discharge amounts that the target head requires is reduced in accordance with the elapsed time.

Although, in the above-described exemplary embodiments, the method for determining the preliminary discharge amounts Dy is simplified by assuming that environmental humidity has no influence, the preliminary discharge amounts may be determined while considering the influence of environmental temperature or environmental humidity. By considering the influence of environmental temperature or environmental humidity, it is possible to more precisely control the preliminary discharge. For example, in a high humidity environment, since the ambient humidity surrounding the head is high, the discharge port surface of the head is not easily dried, as a result of which it is possible to perform preliminary discharge with a smaller preliminary discharge amount. In a low humidity environment, since the ambient humidity around the head is low, the discharge port surface of the head tends to be dry, as a result of which it is necessary to increase the preliminary discharge amount.

Although, in the above-described exemplary embodiments, the case of one-side printing is used as an example, the present invention is applicable to two-side printing. That is, in two-side printing, when, during reverse transport of a printing medium whose front surface has been printed, the printed area of the printing medium whose front surface has been printed passes below the printing head 101, a humidification effect occurs due to the printed image on the front surface, so that it is possible to expect a reduction in the preliminary discharge amounts before printing the back surface of the printing medium.

Although, in the above-described exemplary embodiments, the printing medium is roll paper, the printing medium may be, for example, cut paper or fan fold paper. Depending upon, for example, the type and material of the printing medium, adsorbabilities with respect to moisture (degrees of difficulty of evaporation) differ from each other, as a result of which the humidification effects may also differ from each other. Therefore, the preliminary discharge amounts Dy may also be further corrected in accordance with the type and material of the printing medium.

A plurality of the printing heads 101 of the inkjet printing apparatus may be provided in correspondence with a plurality of inks having different printing colors and densities.

For example, printing modes of the printing apparatus include not only the printing modes for only the main colors, such as black, but also at least one of printing modes for a full color using a plurality of different colors and a full color using mixed colors. Preliminary discharge control may also be performed by performing different weighting operations on preliminary discharge control values while considering differences between components that are contained in inks that are discharged from the respective printing heads, the preliminary discharge control values being selected in accordance with the respective printing heads.

The inks that are used in the inkjet printing apparatus may primarily contain a coloring material (dye or pigment) and a solvent component. The solvent component may be either one of a water-based material or an oil-based material. It is desirable that the dye be a water-soluble dye as typified by a direct dye, an acidic dye, a basic dye, a reactive dye, and a food colorant. As the pigment, it is desirable to use, for example, carbon black. A method that uses both pigment and a dispersant, a method that uses a self-dispersible pigment, and a method that performs microencapsulation may also be used. When necessary, various additives, such as a solvent component, a solubilizer, a viscosity adjuster, a surfactant, a surface tension adjuster, a pH adjuster, and a resistivity adjuster, may be added to the inks.

The inkjet printing apparatus according to the present invention is described as being used as an image output terminal of an information processing device, such a computer. However, I addition to an image output terminal, the inkjet printing apparatus according to the present invention may be applied to, for example, a copying machine combined with a reader or the like or a facsimile device having a transmission and reception function.

The present invention is not limited to only the above-described exemplary embodiments. Changes may be made as appropriate within the scope of the claims and within a scope that is equivalent to the scope of the claims as long as the changes are based on the technical ideas of the present invention.

According to the present invention, it is possible to perform preliminary discharge control while considering the effects of the evaporation of moisture of ink discharged to a printing medium prior to printing on ambient humidity surrounding the printing head. Therefore, it is possible to, without performing excessive preliminary discharge, prevent discharge failure by reducing drying of the printing head and to effectively reduce the consumption of ink used in preliminary discharge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-093917, filed Apr. 30, 2014, which is hereby incorporated by reference herein in its entirety.

What is claimed is:

1. An inkjet printing apparatus comprising:

a transporting unit configured to transport a printing medium in a transport direction;

a first printing head configured to perform a printing operation to print images on the printing medium by discharging ink;

a second printing head positioned downstream from the first printing head in the transport direction and configured to perform a printing operation to print images on the printing medium by discharging ink;

a preliminary discharge controller configured to cause the second printing head to perform a preliminary discharging operation that does not contribute to the printing operation; and a determination unit configured to determine a preliminary discharge amount of the preliminary discharging operation, wherein the preliminary discharge amount when an ink discharge amount of the printing operation by the first printing head is greater than a predetermined value is smaller than a preliminary discharge amount when the ink discharge amount is less than the predetermined value.

2. The inkjet printing apparatus according to claim 1, wherein the preliminary discharge controller determines the preliminary discharge amount based on the ink discharge amount of the first printing head that is discharged to a predetermined printing area of the printing medium in the printing operation.

3. The inkjet printing apparatus according to claim 2, wherein the preliminary discharge controller determines the preliminary discharge amount based on the ink discharge amount of the printing operation and a printing mode of the first printing head.

4. The inkjet printing apparatus according to claim 3, wherein the printing mode is set based on a transport speed of the transporting unit.

5. The inkjet printing apparatus according to claim 4, wherein, when the transport speed is greater than a threshold value, the preliminary discharge amount is smaller than the preliminary discharge amount when the transport speed is less than the threshold value.

6. The inkjet printing apparatus according to claim 2, wherein the preliminary discharge controller determines the preliminary discharge amount based on the ink discharge amount that is discharged to the predetermined printing area in the printing operation by the first printing head and an elapsed time that has elapsed for the predetermined printing area of the printing medium to be transported from a portion opposing the first printing head to a portion opposing the second printing head by the transporting unit.

7. The inkjet printing apparatus according to claim 6, wherein the elapsed time is calculated based on a transport speed of the transporting unit and a distance between the first printing head and the second printing head.

8. The inkjet printing apparatus according to claim 7, wherein, when the elapsed time is less than a threshold value, the preliminary discharge amount is smaller than the preliminary discharge amount when the elapsed time is greater than the threshold value.

9. The inkjet printing apparatus according to claim 2, further comprising a count unit that obtains the ink discharge amount of the printing operation by the first printing head.

10. The inkjet printing apparatus according to claim 9, wherein the second printing head includes a plurality of ink discharge ports that are arranged in a direction that intersects the transport direction, wherein the count unit divides the second printing head into a plurality of processing unit blocks having a predetermined length in the direction of arrangement of the ink discharge ports, divides the predetermined printing area into a plurality of column unit blocks in correspondence with the processing unit blocks, and obtains the ink discharge amount of the printing operation with regard to each column unit block, wherein the plurality of column unit blocks is arranged in the direction that intersects the transport direction, and wherein the preliminary discharge controller determines the preliminary discharge amount based on the ink discharge amount of the printing operation obtained by the count unit.

11. The inkjet printing apparatus according to claim 10, wherein the count unit divides the column unit blocks into a plurality of basic unit blocks arranged in the transport direction and obtains the ink discharge amount of the printing operation by the first printing head with regard to each basic unit block, and wherein the preliminary discharge controller determines the preliminary discharge amount based on the ink discharge amount of the printing operation obtained by the count unit and the number of basic unit blocks, where the ink discharge amount of the printing operation is greater than a threshold value.

12. The inkjet printing apparatus according to claim 11, wherein the first printing head includes a plurality of ink discharge ports that are arranged in the direction that intersects the transport direction, and wherein adjacent basic unit blocks form an overlapping portion in a direction corresponding to the direction of arrangement of the ink discharge ports of the first printing head.

13. The inkjet printing apparatus according to claim 1, wherein the first printing head includes a plurality of unit printing heads, and wherein the preliminary discharge controller determines the preliminary discharge amount based on ink discharge amounts of printing operations of the respective unit printing heads of the first printing head.

14. A method of controlling an inkjet printing apparatus, the method comprising: transporting, via a transporting unit, a printing medium in a transport direction;

performing, via a first printing head, a printing operation to print images on the printing medium by discharging ink;

performing, via a second printing head positioned downstream from the first printing head in the transport direction, a printing operation to print images on the printing medium by discharging ink;

causing, via a preliminary discharge controller, the second printing head to perform a preliminary discharging operation that does not contribute to the printing operation; and determining a preliminary discharge amount of the preliminary discharging operation, wherein the preliminary discharge amount when an ink discharge amount of the printing operation by the first printing head is greater than a predetermined value is smaller than a preliminary discharge amount when the ink discharge amount is less than the predetermined value.

15. An inkjet printing apparatus comprising:

a transporting unit configured to transport a printing medium in a transport direction;

a first printing head configured to perform a printing operation to print images on the printing medium by discharging ink;

a second printing head positioned downstream from the first printing head in the transport direction and configured to perform a printing operation to print images on the printing medium by discharging ink;

a preliminary discharge amount temporary setting unit configured to temporarily set, as a predetermined amount, a preliminary discharge amount of a preliminary discharging operation by the second printing head that does not contribute to the printing operation;

a preliminary discharge amount adjusting unit configured to adjust the predetermined amount based on an ink discharge amount of the printing operation by the first printing head; and a preliminary discharge controller, wherein, in a case where the first printing head performs a printing operation, the preliminary discharge controller causes the preliminary discharging operation to be performed at the second printing head by the ink discharge amount adjusted by the preliminary discharge amount adjusting unit.

16. A method of controlling an inkjet printing apparatus, the method comprising: transporting, via a transporting unit, a printing medium in a transport direction;

performing, via a first printing head, a printing operation to print images on the printing medium by discharging ink;

performing, via a second printing head positioned downstream from the first printing head in the transport direction, a printing operation to print images on the printing medium by discharging ink;

temporarily setting, as a predetermined amount, a preliminary discharge amount of a preliminary discharging operation by the second printing head that does not contribute to the printing operation;

adjusting the predetermined amount based on an ink discharge amount of the printing operation by the first printing head; and causing, in a case where the first printing head performs a printing operation, the preliminary discharging operation to be performed at the second printing head by the ink discharge amount adjusted by the preliminary discharge amount.

* * * * *